US011674302B2

(12) United States Patent
Skov

(10) Patent No.: US 11,674,302 B2
(45) Date of Patent: Jun. 13, 2023

(54) MODULAR ENCLOSURES AND STRUCTURES, AND COMPONENTS THEREOF

(71) Applicant: Rubbermaid Commercial Products LLC, Atlanta, GA (US)

(72) Inventor: Erik Lee Skov, Stanley, NC (US)

(73) Assignee: RUBBERMAID COMMERCIAL PRODUCTS LLC, Atlanta, GA (US)

( * ) Notice: Subject to any disclaimer, the term of this patent is extended or adjusted under 35 U.S.C. 154(b) by 31 days.

(21) Appl. No.: 17/176,854

(22) Filed: Feb. 16, 2021

(65) Prior Publication Data

US 2021/0254327 A1 Aug. 19, 2021

Related U.S. Application Data

(60) Provisional application No. 62/977,584, filed on Feb. 17, 2020.

(51) Int. Cl.

| | |
|---|---|
| ***E04B 1/343*** | (2006.01) |
| ***E04H 1/12*** | (2006.01) |
| ***E04B 7/18*** | (2006.01) |
| ***E04B 2/58*** | (2006.01) |

(52) U.S. Cl.

CPC ..... *E04B 1/34321* (2013.01); *E04B 1/34384* (2013.01); *E04B 2/58* (2013.01); *E04B 7/18* (2013.01); *E04H 1/1205* (2013.01); *E04B 2103/04* (2013.01)

(58) Field of Classification Search

CPC .... E04B 1/34321; E04B 1/34384; E04B 2/58; E04B 7/18; E04B 2103/04; E04H 1/1205

See application file for complete search history.

(56) References Cited

U.S. PATENT DOCUMENTS 2,948,362 A * 8/1960 Jones ..... E04B 1/24 52/460
3,391,512 A * 7/1968 Lopina ..... E04B 2/7854 292/218
3,698,147 A * 10/1972 Sikes ..... E04B 1/6141 52/584.1

(Continued)

OTHER PUBLICATIONS

Rubbermaid® 7' × 7' Storage Building Assembly Instructions, © 2013 Rubbermaid Incorporated, Huntersville, NC USA 28078-1801 (56 pages).

(Continued)

*Primary Examiner* — Gisele D Ford

(74) *Attorney, Agent, or Firm* — Eversheds Sutherland (US) LLP

(57) ABSTRACT

Modular enclosures, structures, and components thereof are provided herein. A modular enclosure may include a plurality of enclosure panels and a dormer. A modular assembly may include first and second panels, an elongated structural reinforcing member, and a connector pin connecting the first and second panels. Another modular assembly may include a molded panel including an elongated channel, an elongated reinforcing member positioned in the channel, and at least one fastener configured to retain the elongated reinforcing member within the channel. The elongated reinforcing member may include pins to be retained within blind bores of the elongated channel.

37 Claims, 22 Drawing Sheets

(56) References Cited

U.S. PATENT DOCUMENTS

| | | | | |
|---|---|---|---|---|
| 6,295,768 | B1 * | 10/2001 | Romero | E04H 1/1205 52/79.6 |
| 6,668,514 | B2 | 12/2003 | Skov | |
| 6,808,674 | B1 | 10/2004 | Skov | |
| 2016/0138258 | A1 * | 5/2016 | Schaffert | E04B 1/34357 52/79.5 |
| 2016/0333582 | A1 * | 11/2016 | Xykis | E04H 1/12 |
| 2020/0224413 | A1 * | 7/2020 | Meisel | E04B 1/98 |

OTHER PUBLICATIONS

Rubbermaid® 5H80 Before You Begin—Surface Preparation, © 2009 Rubbermaid Incorporated, Huntersville, NC USA 28078-1801 (13 pages).

Rubbermaid® 3713 Big Max 7' ×3'6" Resin Storage Building Assembly, © 2003 Rubbermaid Home Products, Wooster, OH, USA 44691-6000 (8 pages).

* cited by examiner

MODULAR ENCLOSURES AND STRUCTURES, AND COMPONENTS THEREOF

CROSS-REFERENCE TO RELATED APPLICATIONS

This application claims the benefit of U.S. Provisional Application No. 62/977,584 filed on Feb. 17, 2020, which is incorporated herein in its entirety by reference.

FIELD OF THE DISCLOSURE

This disclosure relates generally to modular enclosures, structures, and components thereof, and relates specifically to modular storage enclosures and structures, such as sheds and containers, and components thereof.

BACKGROUND

Modular enclosures and structures are known that allow users to connect and configure various panels to form assemblies suitable for storage. For example, storage sheds and outdoor storage containers, or boxes, are known.

Various improvements to such assemblies are described herein, to provide improved properties and features of such assemblies.

SUMMARY

The present disclosure describes modular enclosures, structures, and components thereof. In embodiments according to the present disclosure, a modular enclosure includes a plurality of enclosure panels defining an enclosed storage volume. At least one of the plurality of enclosure panels is a first roof panel, the first roof panel including a dormer opening. The modular enclosure may further include a plurality of dormer wall panels extending from the first roof panel about the dormer opening. The modular enclosure may further include at least one dormer roof panel transverse to the plurality of dormer wall panels. The plurality of dormer wall panels and the dormer roof panel collectively define a dormer. The dormer includes at least one window configured to allow light external to the modular enclosure to enter the storage volume.

In embodiments according to the present disclosure, a modular assembly includes a first panel having a first edge, the first edge including at least one bore. The modular assembly further includes a second panel having a second edge, the second edge including at least one bore. The modular assembly may further include an elongated structural reinforcing member sized and shaped for positioning between the first and second edges. The modular assembly may further include at least one connector pin having two prongs. The connector pin is sized and shaped such that a first prong of a connector pin is positionable within the bore of the first edge and a second prong of the connector pin is positionable within the corresponding bore of the second edge, such that the connector pin connects the first and second panels.

In embodiments according to the present disclosure, a modular assembly includes a first molded panel including an elongated channel formed on a first surface thereof. The elongated channel includes two molded blind bores at opposite ends thereof. The blind bores extending in substantially the same direction as the elongated channel. The modular assembly may further include an elongated reinforcing member positioned in the channel. The elongated reinforcing member includes pins extending from opposite ends thereof. The pins are sized and shaped to be retained within the blind bores. The modular assembly may further include at least one fastener configured to retain the elongated reinforcing member within the channel. The elongated reinforcing member provides structural reinforcement to the first molded panel.

BRIEF DESCRIPTION OF THE DRAWINGS

The detailed description is set forth with reference to the accompanying drawings. The use of the same reference numerals may indicate similar to identical items. Various embodiments may utilize elements and/or components other than those illustrated in the drawings, and some elements and/or components may not be present in various embodiments. Elements and/or components in the figures are not necessarily drawn to scale.

DETAILED DESCRIPTION

The present disclosure includes non-limiting embodiments of modular assemblies having various improved features, such as connection means, reinforcing means, and/or a dormer. The embodiments are described in detail herein to enable one of ordinary skill in the art to practice the assemblies and structures and associated methods of making, although it is to be understood that other embodiments may be utilized and that logical changes may be made without departing from the scope of the disclosure. Throughout the disclosure, depending on the context, singular and plural terminology may be used interchangeably.

Various modular enclosures, assemblies and structures, as well as the components and features thereof, are described herein. As used herein, the term "modular" is used to refer to assemblies formed by sections or components (e.g., panels) that are configured for connection and assembly into an enclosure by a user.

Modular enclosures and structures are known that allow users to connect and configure various panels to form assemblies suitable for storage. For example, storage sheds and outdoor storage containers, or boxes, are known. Various improvements to such assemblies are described herein, to provide improved properties and features of such assemblies.

Connection Means for Modular Assemblies

Embodiments of the modular assemblies described herein may include connected abutting or otherwise adjacent panels. For example, modular assemblies such as sheds, fences, and containers such as storage boxes, may utilize such connection means to provide a secure attachment of adjacent panels. The panels may be any suitable panels, and in some embodiments are substantially planar.

Traditional methods of connecting such adjacent panels may utilize overlapping joints with threaded fasteners (e.g., screws) used to connect the overlap, or may utilize overlapping joints that employ a structural member engaged to one of the adjacent panel edges. Such connections may suffer from insecure attachments or other structural issues.

In certain embodiments, a modular assembly includes a first panel having a first edge including at least one bore, a second panel having a second edge including at least one bore, an elongated structural reinforcing member sized and shaped for positioning between the first and second edges, and at least one connector pin having two prongs, wherein the connector pin is sized and shaped such that a first prong of a connector pin is positionable within the bore of the first edge and a second prong of the connector pin is positionable within the corresponding bore of the second edge, such that the connector pin connects the first and second panels. Such connection means may incorporate relevant aspects of U.S. Pat. No. 6,668,514, which is incorporated by reference herein in its entirety.

Figure 11:
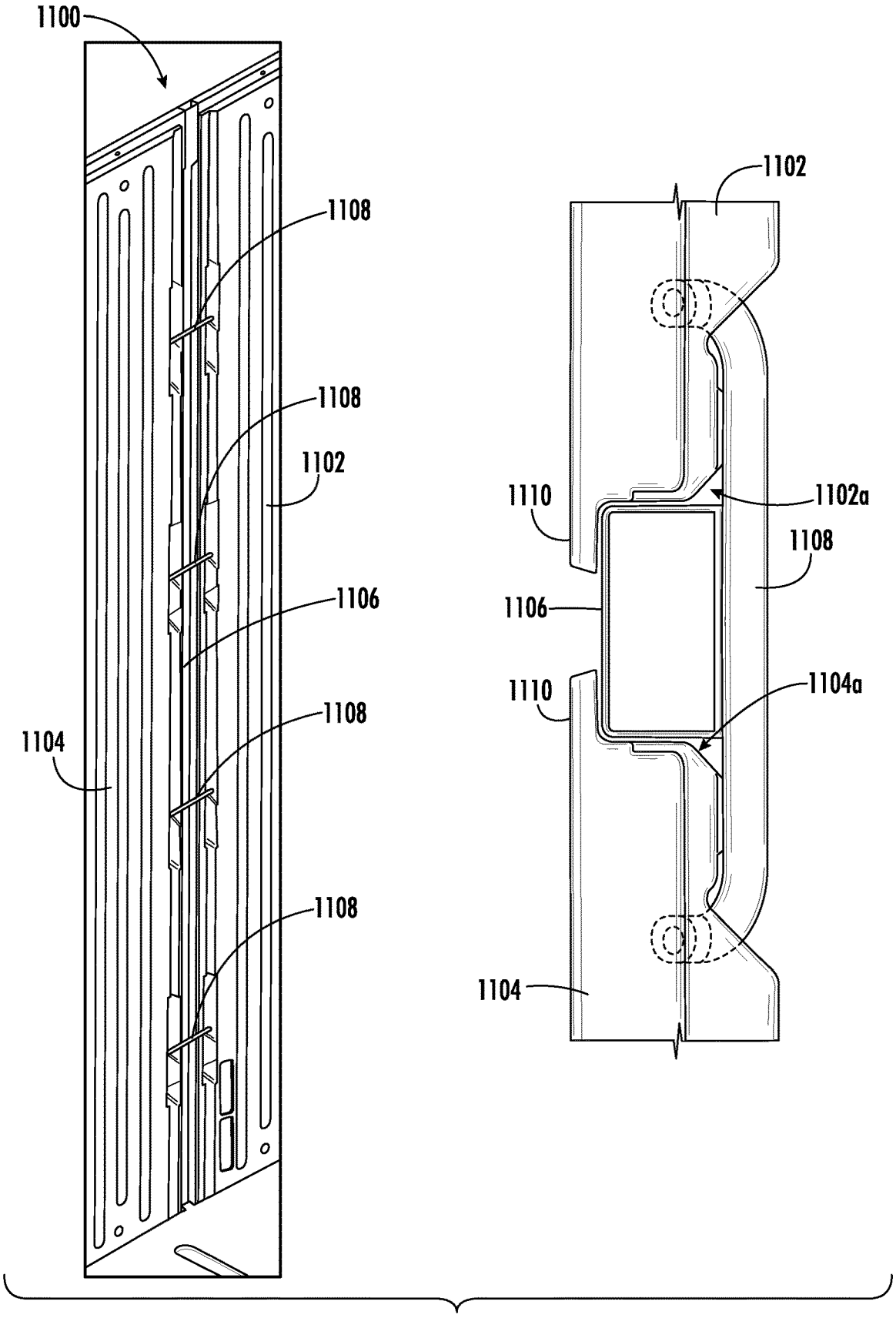
FIG. 11 is a perspective and a top view of a modular assembly of two panels having an elongated structural reinforcing member and a connector pin.
Figure 12:
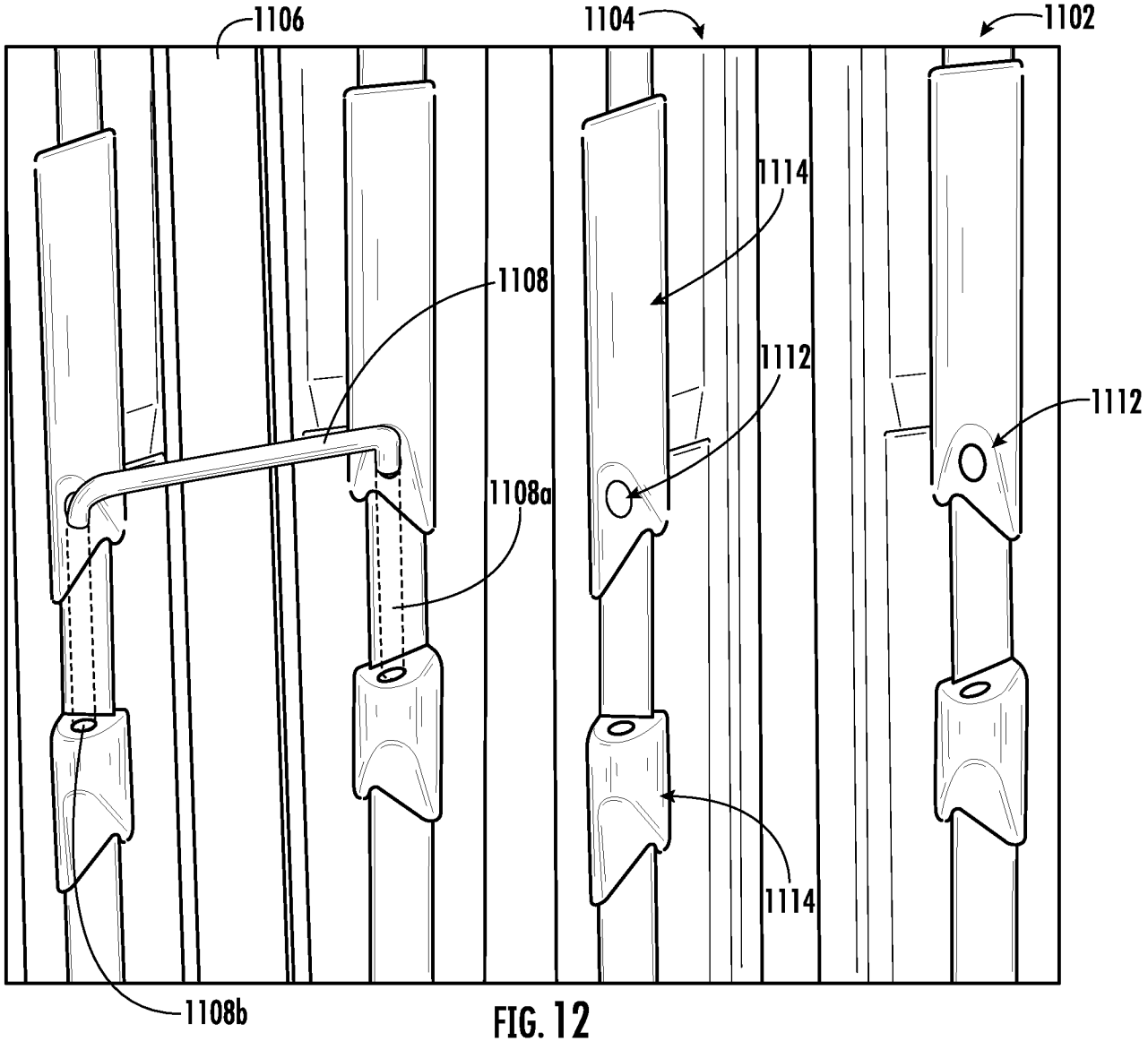
FIG. 12 is an x-ray perspective and a regular perspective view of the joint of two panels with an elongated structural reinforcing member and a connector pin.
Figure 13:
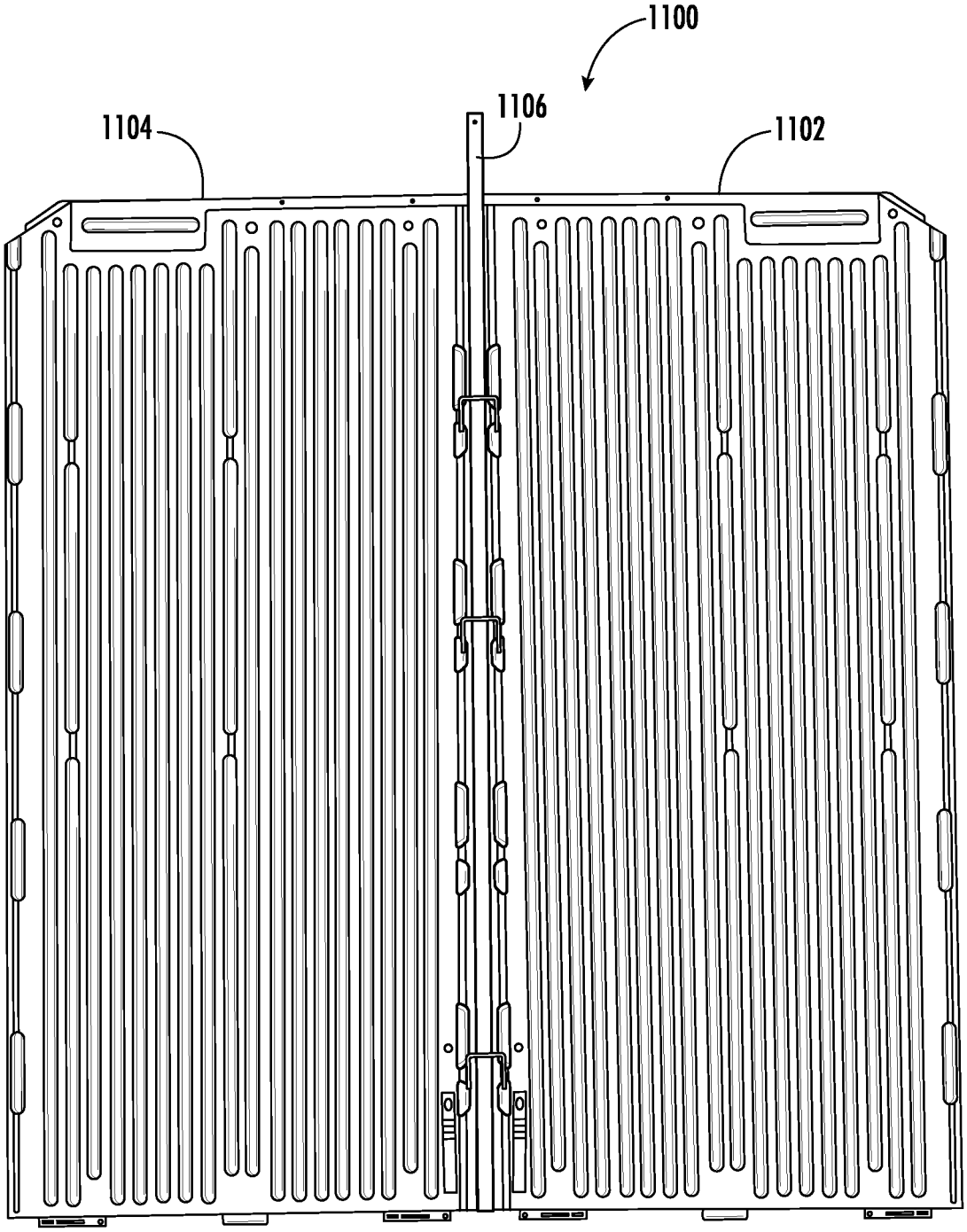
FIG. 13 is a perspective view of an assembled modular assembly of two panels having an elongated structural reinforcing member and a connector pin.
Figure 14:
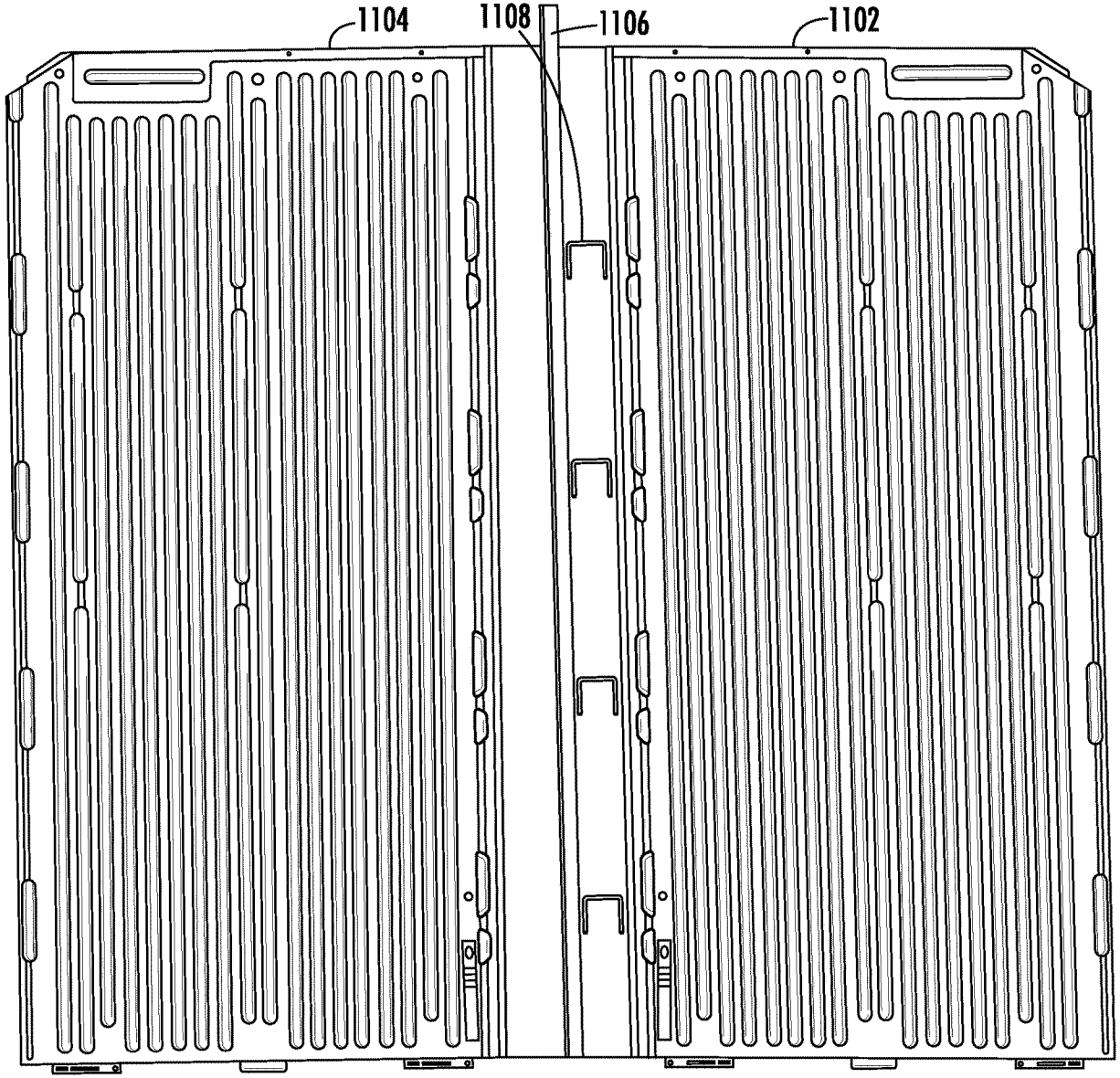
FIG. 14 is a perspective view of an exploded modular assembly of FIG. 13.
Figure 15:
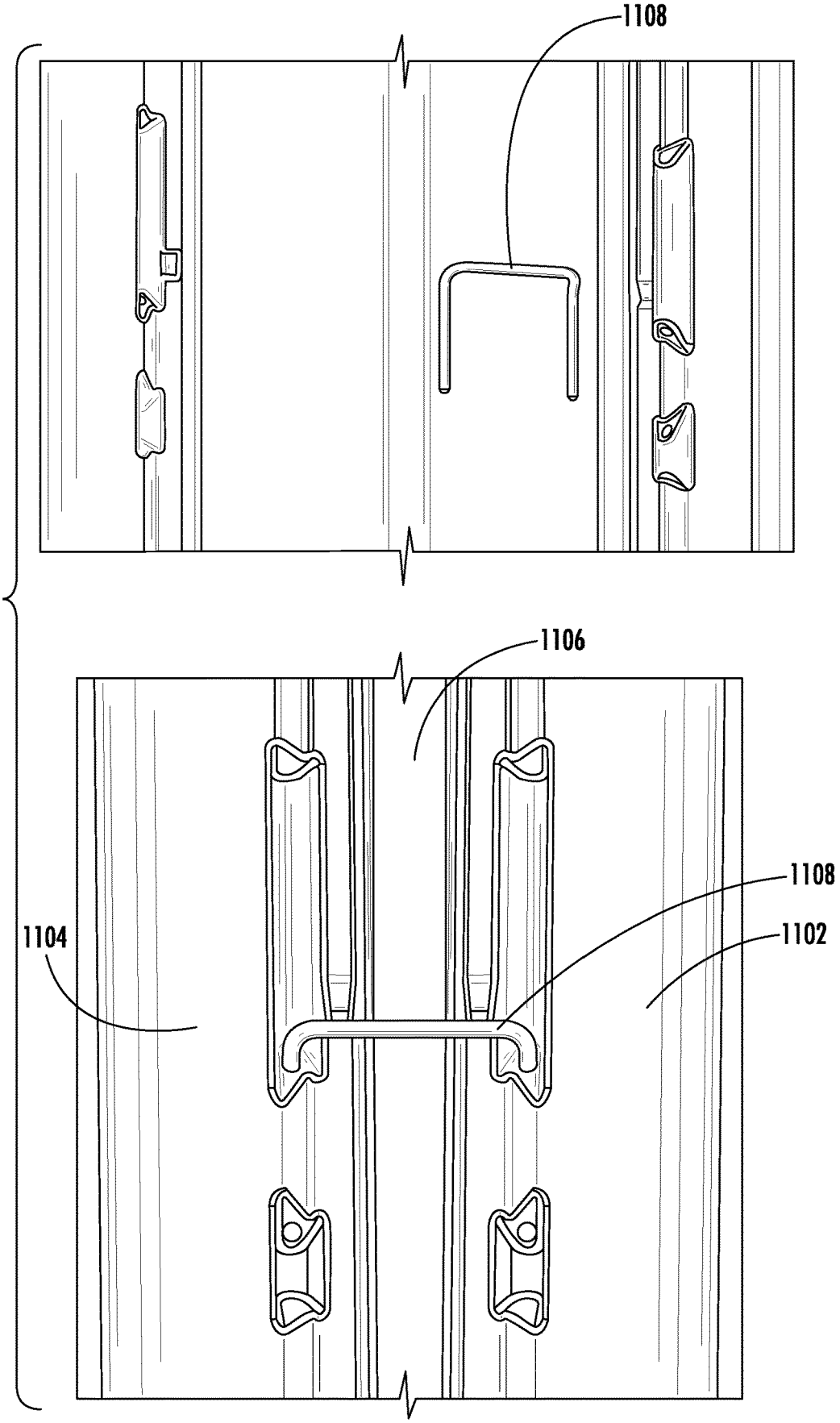
FIG. 15 is a perspective magnified view of an exploded and an assembled modular assembly of two panels having an elongated structural reinforcing member and a connector pin.
Figure 16:
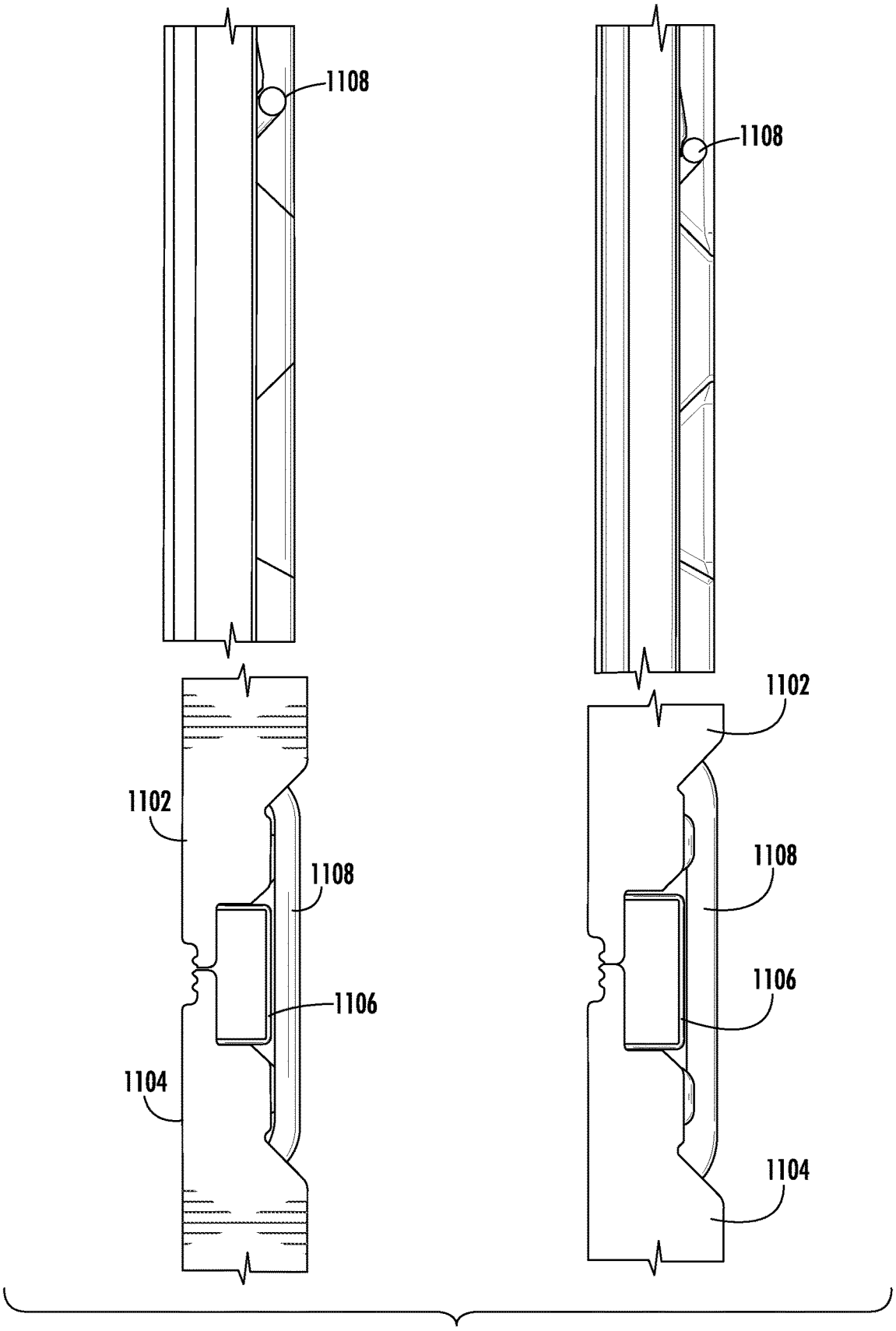
FIG. 16 are cross-sectional views of an elongated reinforcing member and connector pin assembly.
Figure 17:
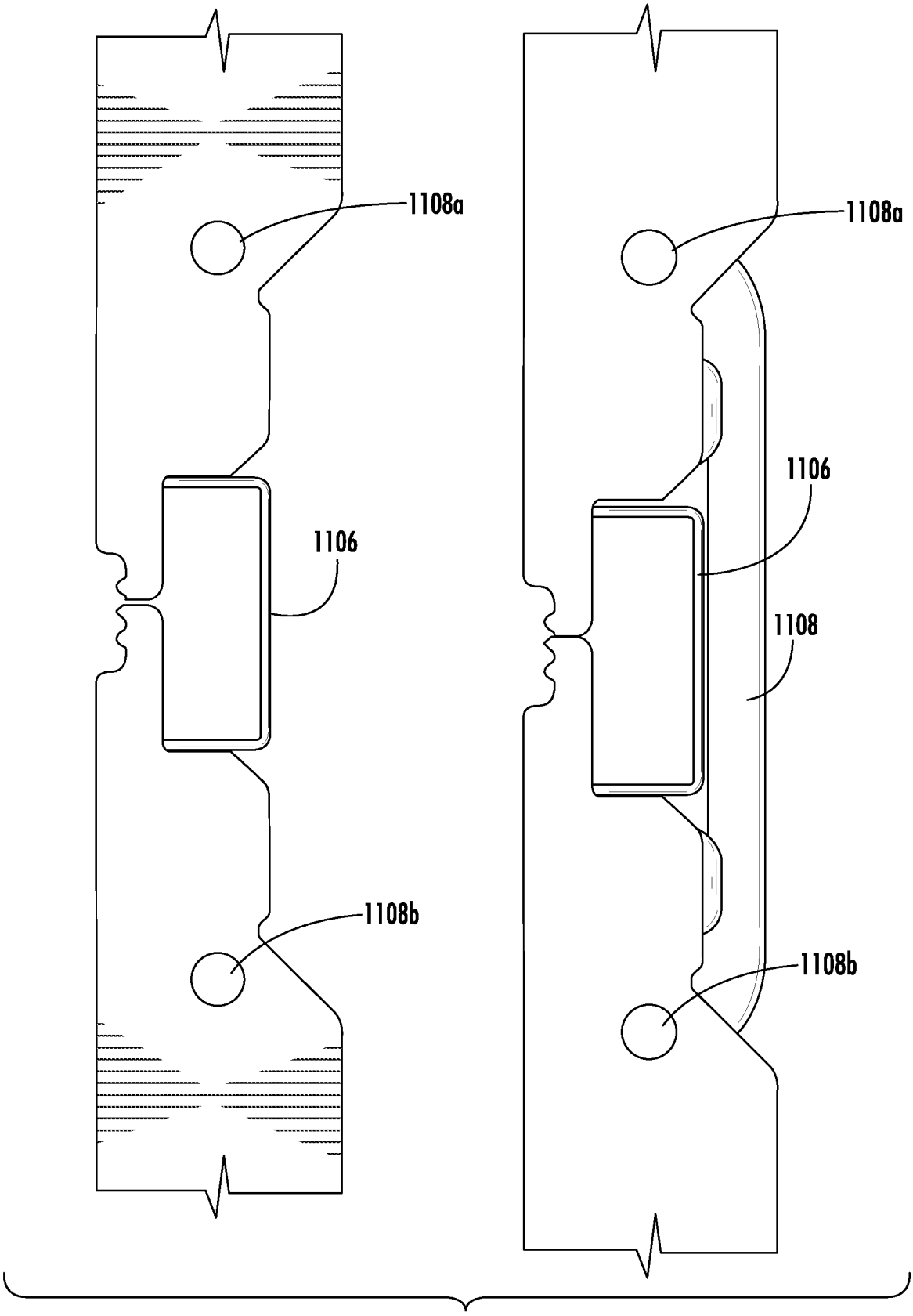
FIG. 17 are cross-sectional views of an elongated reinforcing member and connector pin assembly.
Figure 18:
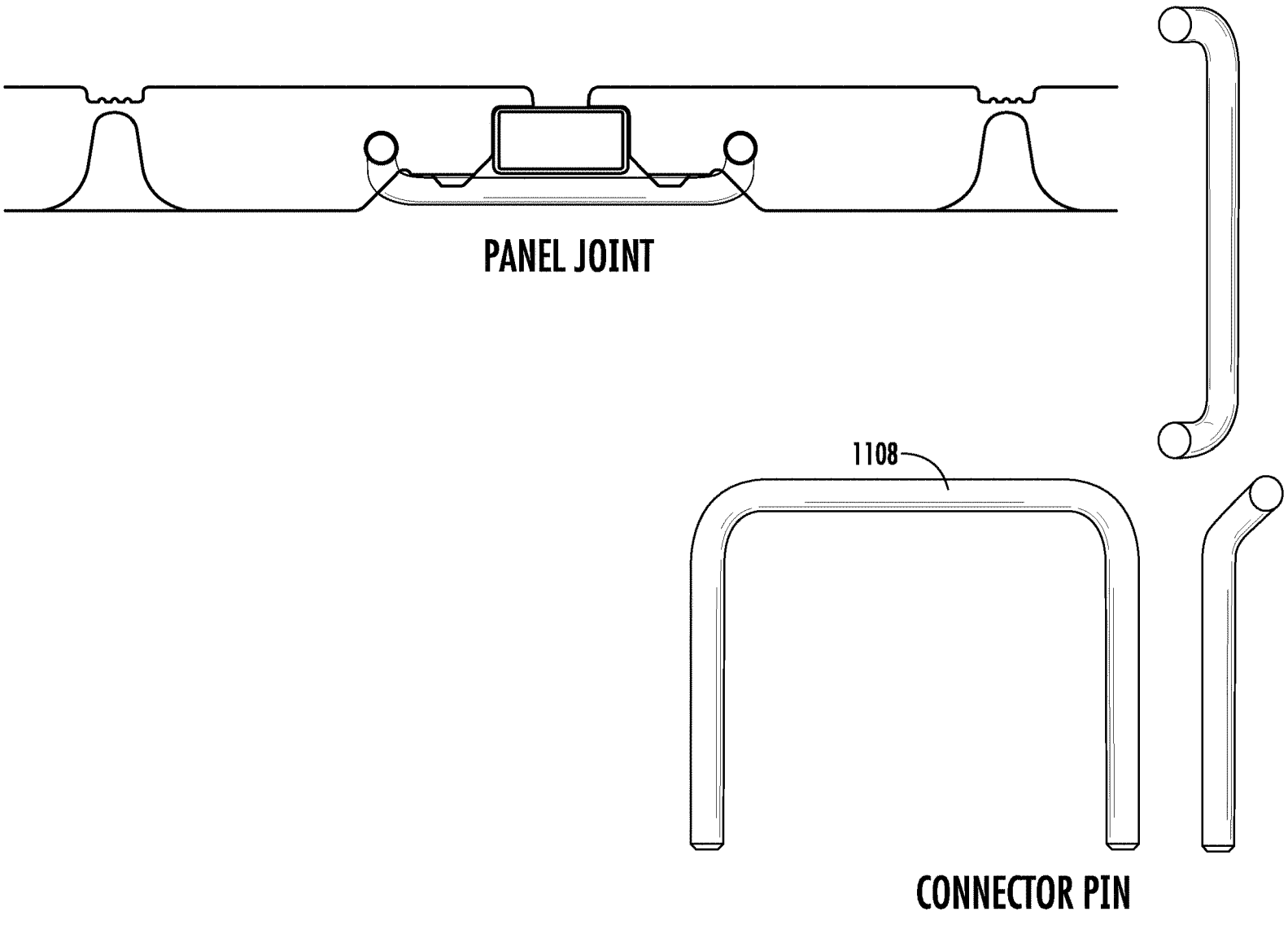
FIG. 18 are perspective and cross-sectional views of an elongated reinforcing member and connector pin assembly.

FIG. 11 is a perspective and a top view of a modular assembly of two panels having an elongated structural reinforcing member and a connector pin. FIG. 12 is an x-ray perspective and a regular perspective view of the joint of two panels with an elongated structural reinforcing member and a connector pin. FIG. 13 is a perspective view of an assembled modular assembly of two panels having an elongated structural reinforcing member and a connector pin. FIG. 14 is a perspective view of an exploded modular assembly of FIG. 13. FIG. 15 is a perspective magnified view of an exploded and an assembled modular assembly of two panels having an elongated structural reinforcing member and a connector pin. FIG. 16 are cross-sectional views of an elongated reinforcing member and connector pin assembly. FIG. 17 are cross-sectional views of an elongated reinforcing member and connector pin assembly. FIG. 18 are perspective and cross-sectional views of an elongated reinforcing member and connector pin assembly.

As illustrated in these figures, a modular assembly 1100 includes a first panel 1102 having a first edge 1102*a* including at least one bore 1112, a second panel 1104 having a second edge 1104*a* including at least one bore 1112, an elongated structural reinforcing member 1108 sized and shaped for positioning between the first and second edges 1102*a*, 1104*a*, and at least one connector pin 1108 having two prongs 1108*a*, 1108*b*, wherein the connector pin 1108 is sized and shaped such that a first prong 1108*a* of a connector pin 1108 is positionable within the bore 1112 of the first edge 1102*a* and a second prong 1108*b* of the connector pin 1108 is positionable within the corresponding bore 1112 of the second edge 1104*a*, such that the connector pin 1108 connects the first and second panels 1102, 1104.

The elongated structural reinforcing member 1108 may be any suitable size, shape, and material to provide the desired structural reinforcement for the joint of the first and second panels 1102, 1104. For example, the elongated structural reinforcing member 1108 may be tubular, with any suitable cross-sectional shape (e.g., circular, oval, elliptical, rectangular, square). The reinforcing member may be hollow or solid in construction. In some embodiments, the structural reinforcing member is a metal tube.

In certain embodiments, as shown in the right-hand view of FIG. 11, the lower views of FIG. 16, FIG. 17, and the lower view of FIG. 18, at least one of the first and second panels 1102, 1104 has an overhang (e.g., projection, ledge) 1110 extending past the respective panel edge 1102*a*, 1104*a*, such that the overhang 1110 in combination with the at least one connector pin 1108 laterally restrains at least a portion of the elongated structural reinforcing member 1106. That is, the overhang 1110 may at least partially define a recess for receiving the structural reinforcing member 1106. For example, the overhang 1110 may extend along a portion of or the entire length of the first edge 1102*a* or the second edge 1104*a*. In certain embodiments, as shown in the referenced figures, both the first and second panels 1102, 1104 have an overhang 1110 extending past the respective panel edges 1102*a*, 1104*a*, such that the overhangs 1110 in combination with the at least one connector pin 1108 laterally restrain the elongated structural reinforcing member 1106. That is, the overhangs may abut one another to define a recess for receiving the structural reinforcing member 1106.

As shown in the left-hand view of FIG. 11, FIG. 13, and FIG. 14, the first and second edges 1102*a*, 1104*a* may each contain a series of corresponding bores 1112, configured to receive a corresponding number of connector pins 1108 therein, to connect the first and second panels 1102, 1104 along a length of the first and second edges 1102*a*, 1104*a*. For example, the bores may be spaced equidistantly along the first or second edge 1102*a*, 1104*a*, or may be spaced intermittently based on requisite securing positions and/or to accommodate features such as handles along the edges. Each bore should have a corresponding bore 1112 on the edge of the adjacent panel, collectively to accommodate the two prongs 1108*a*, 1108*b* of a connector pin 1108.

The bores 1112 may have any suitable size, shape, and position to securely receive the prong 1108*a*, 1108*b* of a connector pin 1108. In certain embodiments, the bores are blind bores. In other embodiments, as shown in the figures, the bores are through-holes. In certain embodiments, the bores extend in a direction substantially parallel to a direction in which the elongated structural reinforcing member extends; however, any suitable direction of the bores may be used. In certain embodiments, the bores 1112 include an interference feature to prevent movement of a connector pin 1108 positioned therein. Such interference feature may be mechanical, such as a notch, or similar retention feature, or may be due to the geometry of the bore with respect to the connector pin (e.g., an angled bore). Thus, the interference feature may prevent the pin from moving out of the connecting position. The bores may be manufactured through methods such as described in U.S. Pat. No. 6,808,674, which is incorporated by reference herein in its entirety.

In certain embodiments, such as shown in FIG. 12, the first and second edges 1102*a*, 1104*a* each include a groove 1114 or pair of grooves 1114 adjacent the bore 1112, to provide access to the bores. For example, the grooves 1114 may provide a user with the necessary cavity volume in which to position and install the connector pin 1108 in the corresponding bore 1112 or in which the ends of the prongs 1108*a*, 1108*b* may extend.

As shown in FIG. 18, the connector pin 1108 may have any suitable shape, configuration, and material. For example, the connector pin may have a substantially u-shape in which the two prongs 1108*a*, 1108*b* extend substantially perpendicularly from a connecting rod. As shown in FIGS. 12 and 15, the connecting rod may be positioned outside of a two-dimensional plane in which the two prongs 1108*a*, 1108*b* lie. That is, the prongs 1108*a*, 1108*b* may be attached to the connecting rod by prong segments that are angled with respect thereto. Such a configuration may provide an interference feature that prevents the pin 1108 from moving out of the bores 1112. In certain embodiments, the connector pin has a u-shape. In certain embodiments, the connector pin is formed of metal.

In certain embodiments, the bores 1112 and the connector pin 1108 are sized and shaped to provide secure attachment of the first and second panels 1102, 1104 in a direction parallel to and/or perpendicular with the first and second panels 1102, 1104.

Thus, these assemblies and connection means may provide an improved joining method, along with improved structural performance of the joined panels. The configuration of these components may provide secure attachment in directions parallel and perpendicular to the wall construction. The elongated reinforcing member may provide greater structure versus a joint that only has panels in combination with traditional connectors and/or fasteners. That is, the application of a structural member between adjacent panels held in place by connectors, creating a captured joint assembly, may provide an improved structural connection for such modular panels.

In certain embodiments, methods of constructing a modular assembly such as described above are also provided. Such methods may include positioning the elongated structural reinforcing member in a recess formed between the first and second edges, and positioning the prongs of the at least one connector pin in the corresponding bores of the first and second edges, to securely connect the first and second panels.

Reinforcing Means for Modular Assemblies

In certain embodiments, as shown in FIGS. 1-10, modular assemblies are provided that include at least one molded panel having a reinforcing member to provide further structural support to the panel. Suitable panels for modular assemblies, such as fences, sheds, containers, and other enclosures, are known. It should be understood that the reinforcing means described herein may be used in combination with any known modular panels.

In certain embodiments, a modular assembly includes a first molded panel having an elongated channel formed on a first surface thereof and having two molded blind bores at opposite ends thereof, the blind bores extending in substantially the same direction as the elongated channel, an elongated reinforcing member positioned in the channel and including pins extending from opposite ends thereof, the pins being sized and shaped to be retained within the blind bores, and at least one fastener configured to retain the elongated reinforcing member within the channel, wherein the elongated reinforcing member provides structural reinforcement to the first molded panel.

Figure 1:
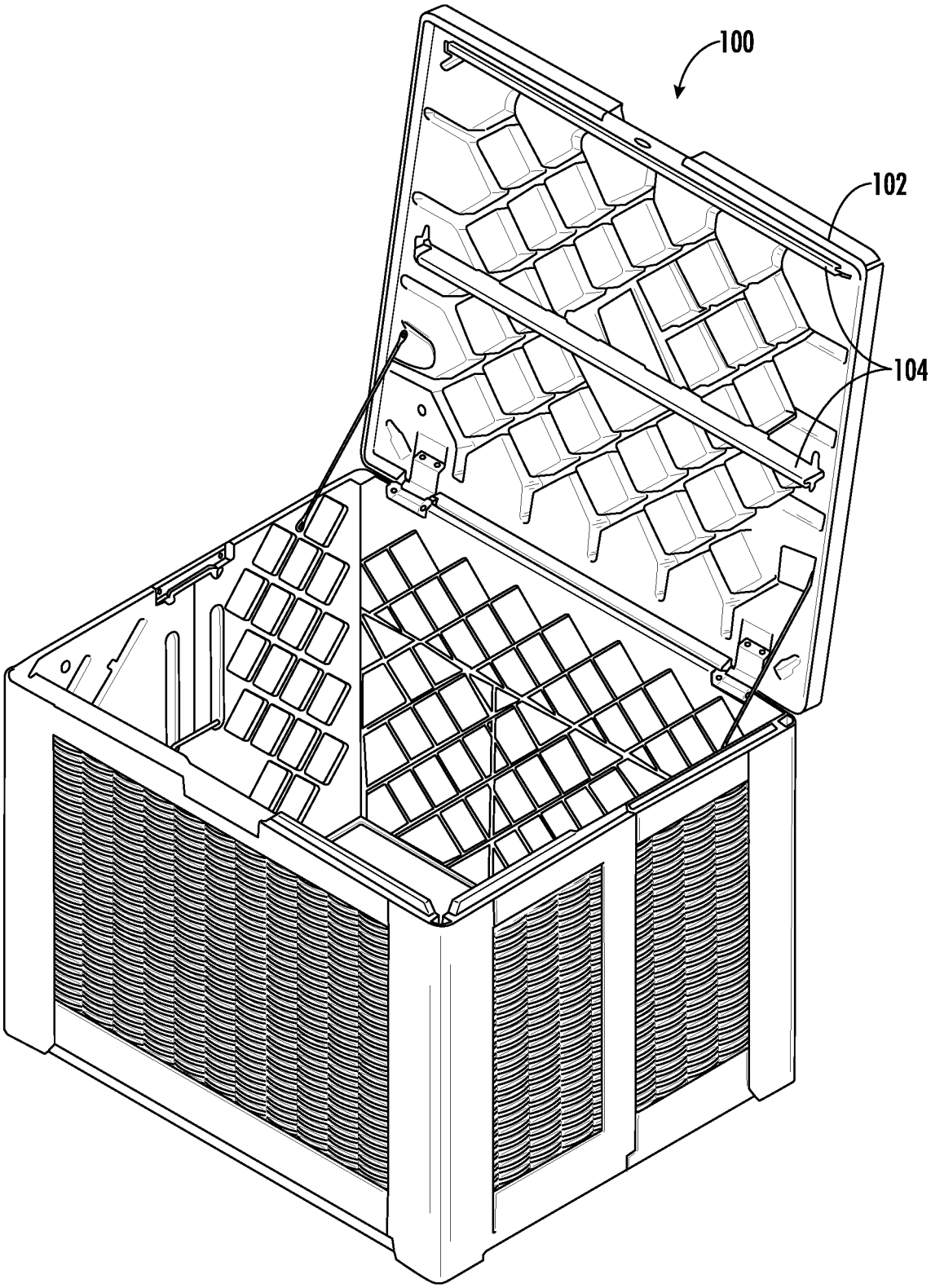
FIG. 1 is a perspective view of a modular storage container assembly having a reinforcing member.
Figure 2:
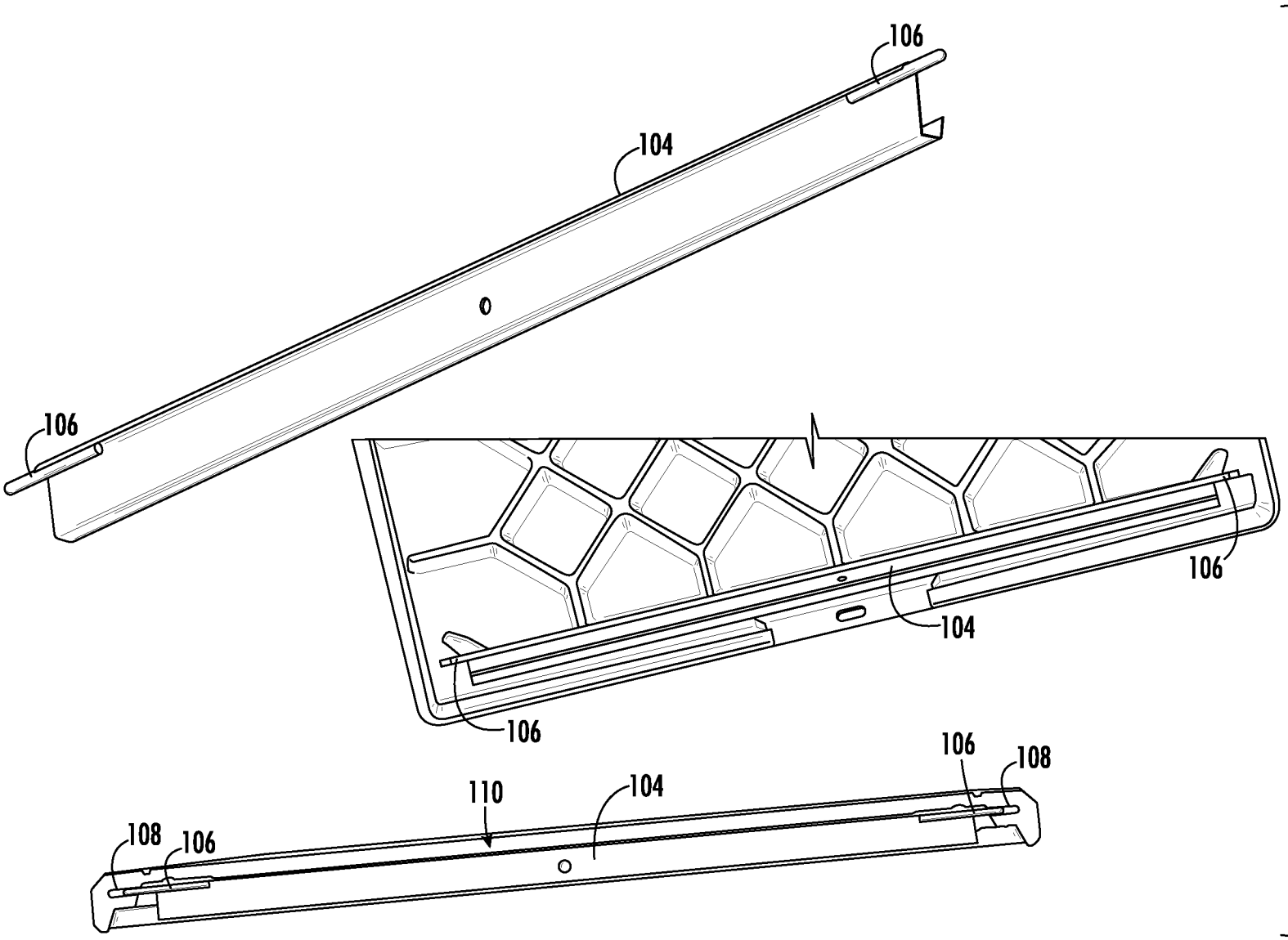
FIG. 2 is various views of the reinforcing member of FIG. 1 in the channel of a panel.
Figure 3:
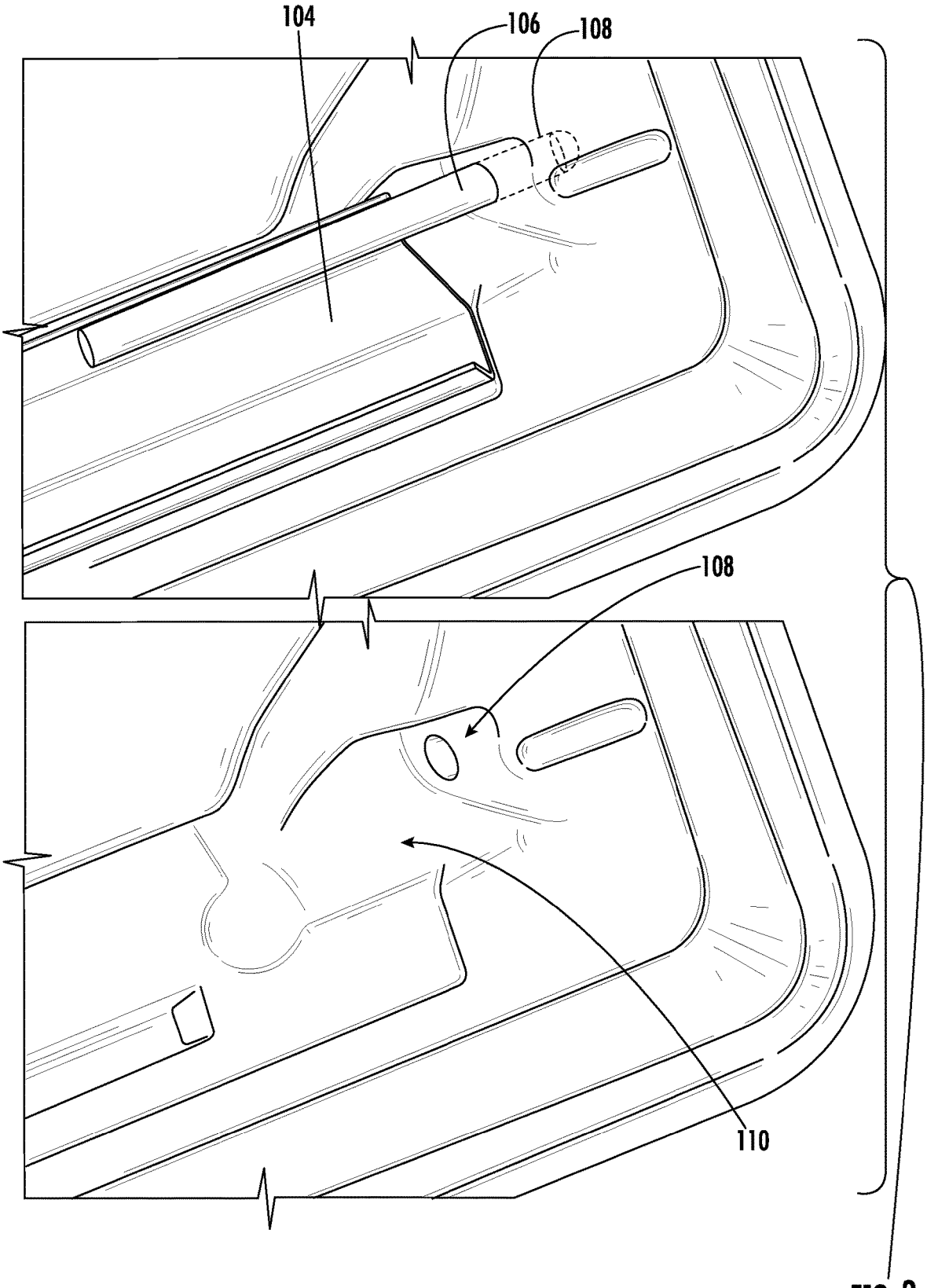
FIG. 3 is various magnified views of the reinforcing member, channel and bores of the molded panel of FIG. 1.
Figure 4:
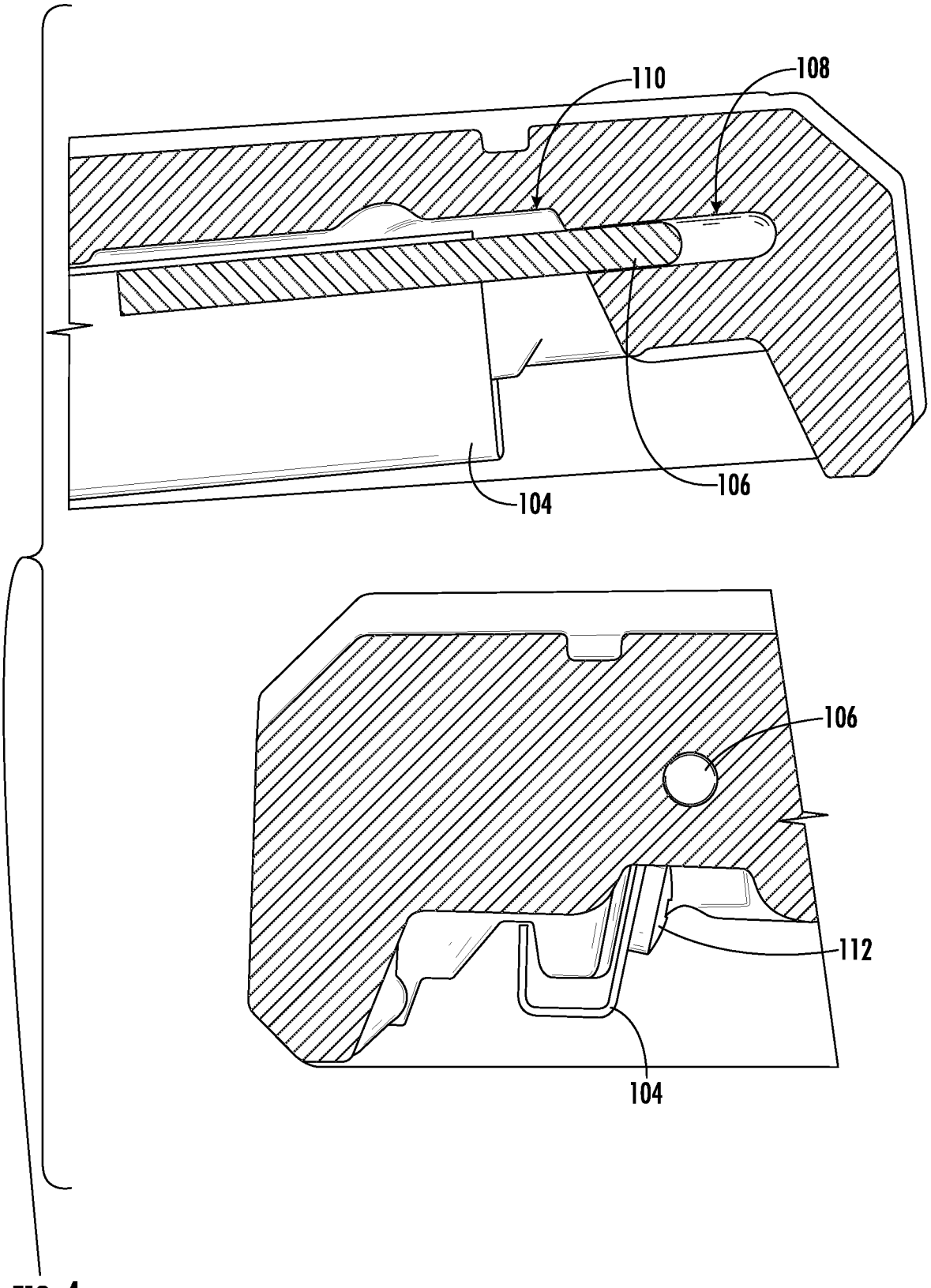
FIG. 4 is various magnified views of the reinforcing member secured within the channel of FIG. 1.
Figure 5:
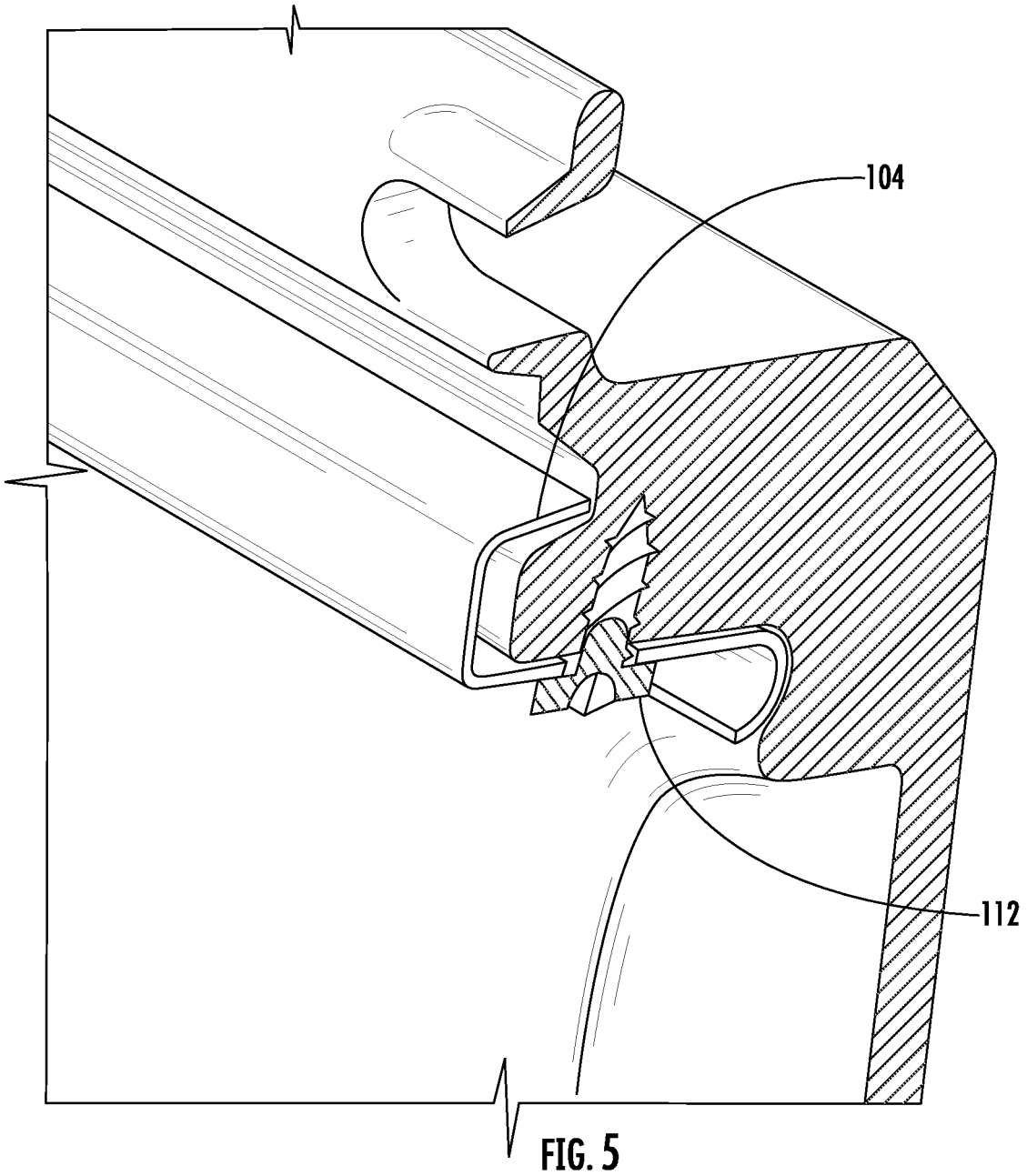
FIG. 5 is a cross-sectional view of the reinforcing member secured within the channel of FIG. 1.
Figure 6:
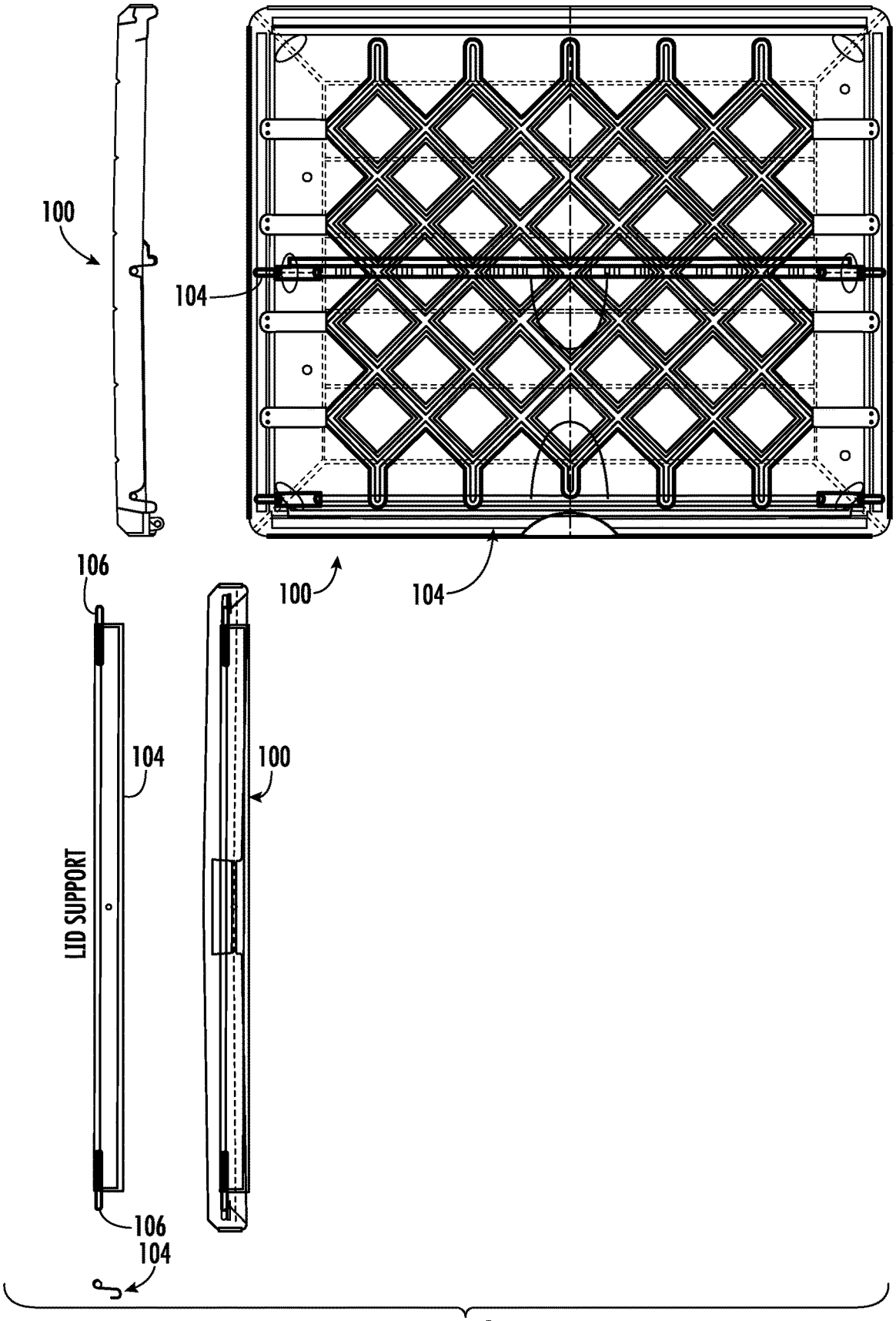
FIG. 6 is various plan views showing the lid of a modular storage container having two reinforcing members therein.

While embodiments of these reinforced panels are described and illustrated with respect to panels forming the lid for a container and panels forming the door of a shed, it should be understood that the reinforcing means may be applied to any suitable panel type. FIG. 1 is a perspective view of a modular storage container assembly having a reinforcing member. FIG. 2 is various views of the reinforcing member of FIG. 1 in the channel of a panel. FIG. 3 is various magnified views of the reinforcing member, channel and bores of the molded panel of FIG. 1. FIG. 4 is various magnified views of the reinforcing member secured within the channel of FIG. 1. FIG. 5 is a cross-sectional view of the reinforcing member secured within the channel of FIG. 1. FIG. 6 is various plan views shows the lid of a modular storage container having two reinforcing members therein.

As shown in FIGS. 1-6, a modular assembly 100 (here, a storage container) includes a first molded panel 102 (here, a lid for the storage container) having an elongated channel 110 formed on a first surface thereof and having two molded blind bores 108 at opposite ends thereof, the blind bores 108 extending in substantially the same direction as the elongated channel 110, an elongated reinforcing member 104 positioned in the channel 110 and including pins 106 extending from opposite ends thereof, the pins 106 being sized and shaped to be retained within the blind bores 108, and at least one fastener 112 configured to retain the elongated reinforcing member 104 within the channel 110, wherein the elongated reinforcing member 104 provides structural reinforcement to the first molded panel 102.

In certain embodiments, the first panel 102, the elongated channel 110, and the blind bores 108 are blow molded in a single blow-molding step. For example, relevant teachings regarding blow-molding methods that may be used for the manufacture of such parts may be found in U.S. Pat. No. 6,808,674, which is incorporated by reference herein in its entirety.

Thus, in certain embodiments, the first panel 102 is formed of a molded plastic material. In certain embodiments, the reinforcing member 104 and pins 106 are formed of metal. The pins 106 may be associated with the reinforcing member 104 by any suitable direct or indirect coupling means (e.g., welding, adhesives, mechanical connection means), or the pins 106 may be formed as a solid member with the reinforcing member 104.

In certain embodiments, a panel 102 contains more than one channel 110 and thereby is configured to receive more than one reinforcing member 104. In certain embodiments, at least one elongated channel 110 is at or adjacent an edge of the first molded panel 102, with the elongated channel 110 extending substantially parallel to the edge. Beneficially, such design may provide an improved method to capture the ends of a structural member to a plastic part (e.g., panel), thereby providing greater resistance to distortions closer to the edges of the plastic part (e.g., plastic panel).

As shown throughout the figures, the elongated reinforcing member 104 may be formed of a sheet-like material that has been shaped to conform to and provide the required support to the panel 102 and channel 104. That is, the surface of the reinforcing member 104 may generally correspond in shape to the surface of the elongated channel 110 that it supports. For example, the reinforcing member 104 may have a cross-sectional shape that is curved, serpentine, S-shaped, J-shaped (see FIG. 2), or otherwise fit to the corresponding surface of the elongated channel.

The bores 108 are encapsulated holes (i.e., blind bores) and are sized and shaped to receive the pins 106 of the reinforcing member 104. In certain embodiments, as shown in FIG. 4, the elongated channel 110 and the elongated reinforcing member 104 are sized and shaped such that the channel 110 accommodates installation of a first of the pins 106 into a first of the blind bores 108, with clearance in the channel 110 to then install a second of the pins 106 into a second of the blind bores 108 at the opposite end. That is, the structural reinforcing member 104 may have appropriately shaped ends that engage the molded feature of the plastic part (e.g., panel) 102, engagement is made by first inserting an end of the structural reinforcing member 104 into the molded feature (bore) 108 of the plastic part 102, then sliding it such that allows the other end to engage into a second molded feature 108 of the plastic part 102, and then centering such that each end 106 remains engaged in the bore, and finally using a single fastening step to maintain the position of the reinforcing member 104.

In certain embodiments, the reinforcing member 104 is fastened to the panel 102 by at least one fastener 112, such as a threaded fastener (e.g., screw, bolt/nut). FIG. 5 shows a screw 112 that holds the metal reinforcing member 104 in place and prevents shifting side-to-side in order to maintain engagement of the pins 106 at each end. In certain embodiments, only a single fastener 112 is required to hold the reinforcing member 104 in place.

It has been found that this reinforcing support means provides an improved method for attaching structural components to plastic parts, while also reducing the required fastening steps (e.g., reduces the number of threaded fasteners needed). Additionally, these assemblies provide more support structures to the assembly while simultaneously reducing the number of parts/screws needed. Further, these assemblies increase rigidity of the panels by allowing the metal (e.g., pin) to extend further in a slot. In the embodiment of FIGS. 1-6, the metal reinforcement provides support to a deck box lid, the reinforcement having pins affixed or coupled at each end, the pins engaging into the enclosed areas of the blow molded article to secure the lid and support along the critical edges thus providing resistance to deflection due to top load (seating) and heat histories (warp induced by heating/cooling cycles from sunlight).

Figure 7:
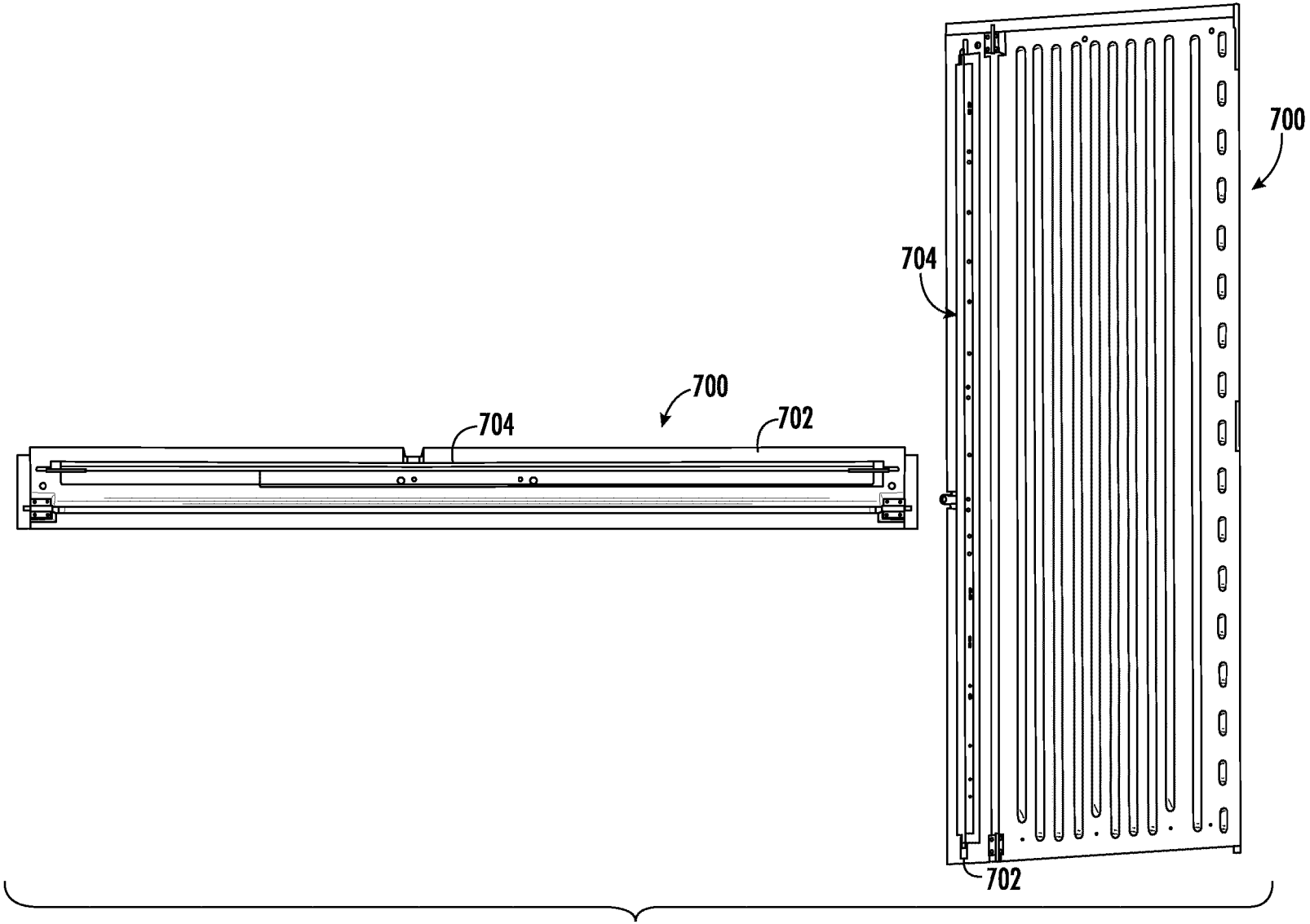
FIG. 7 is two perspective views showing a modular panel member (door) having a reinforcing member.
Figure 8:
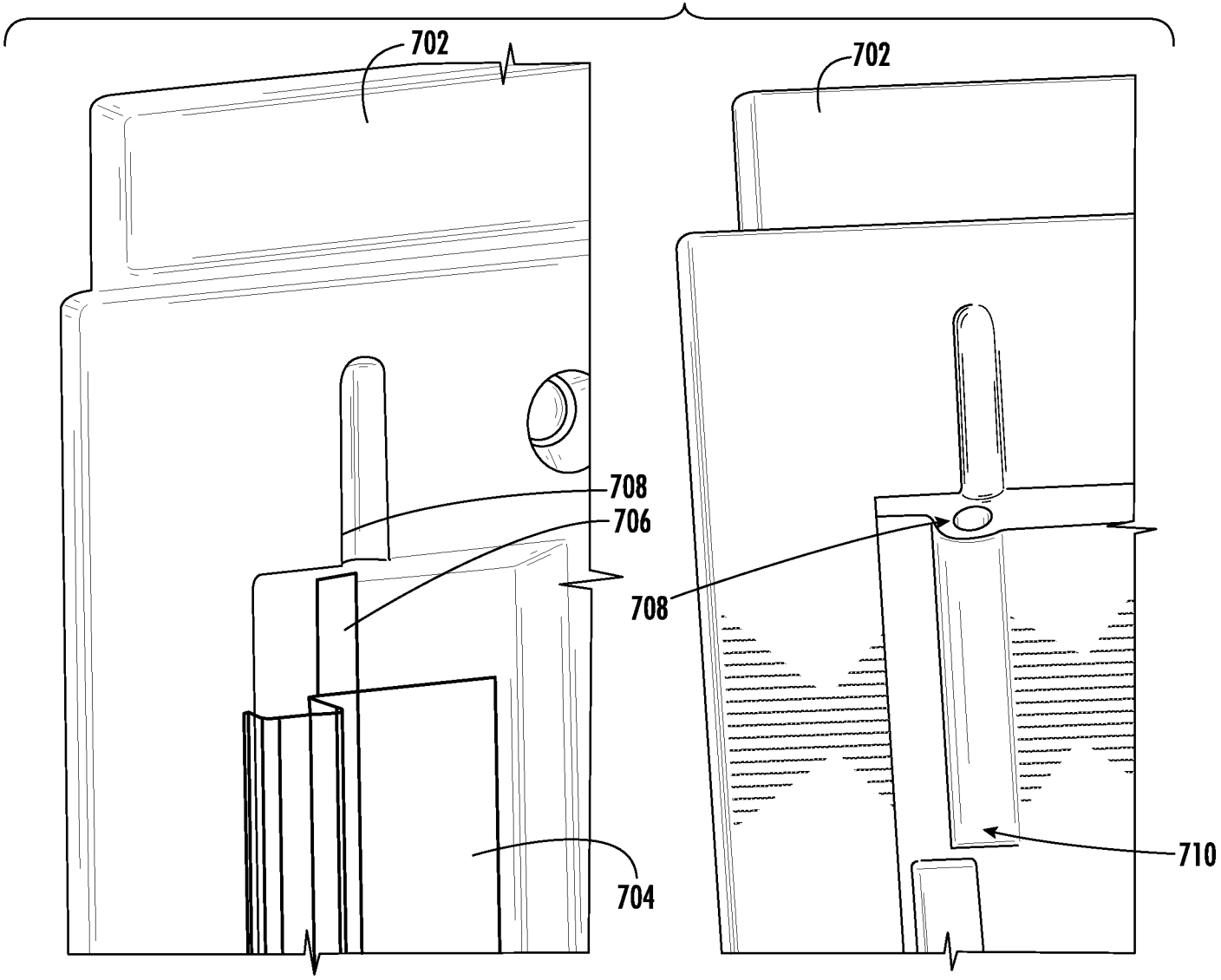
FIG. 8 is two magnified views of one end of the reinforcing member, channel and bores of the panel of FIG. 7.
Figure 9:
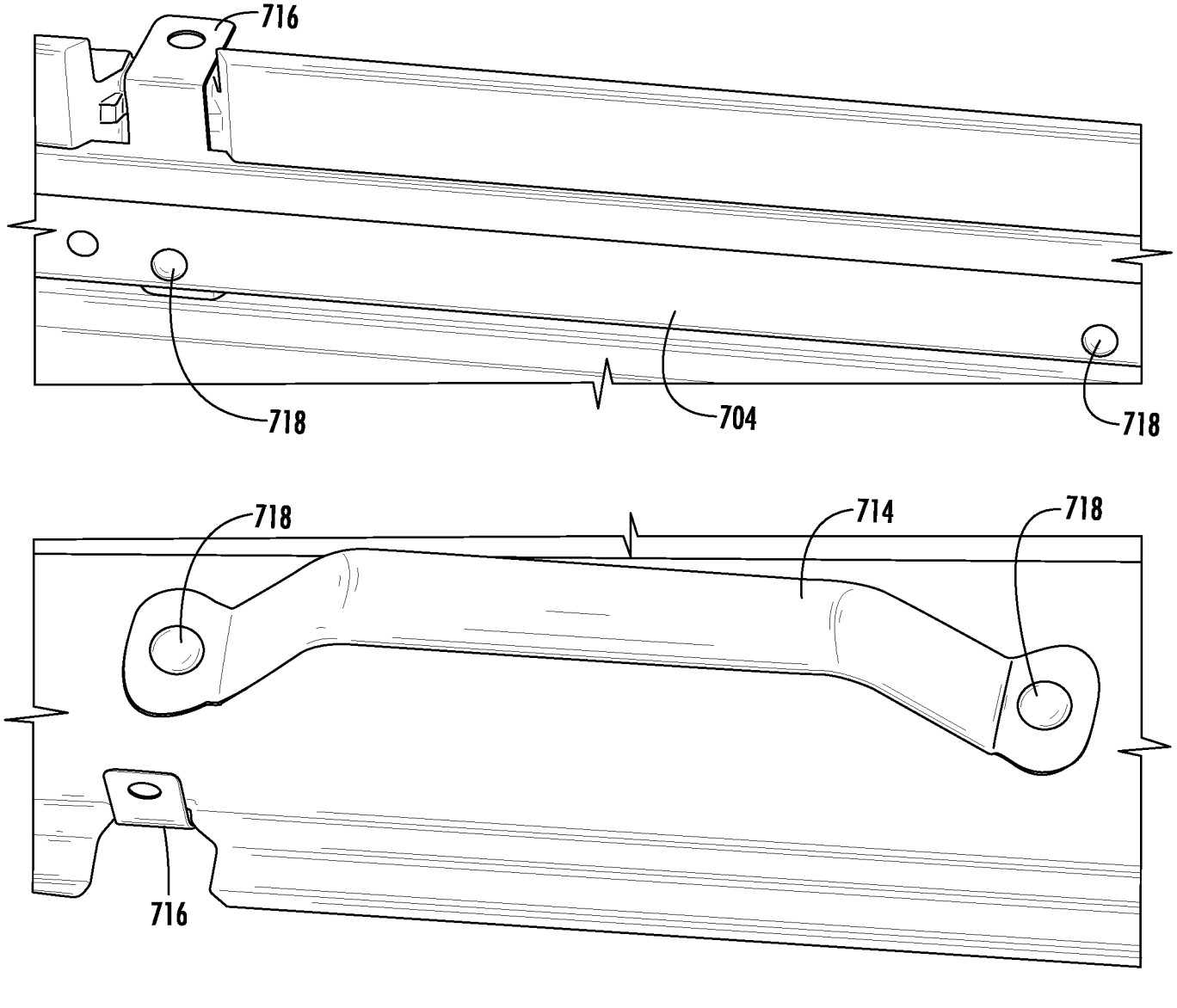
FIG. 9 is two views showing the handle and lock hasp of the assembly of FIG. 7.
Figure 10:
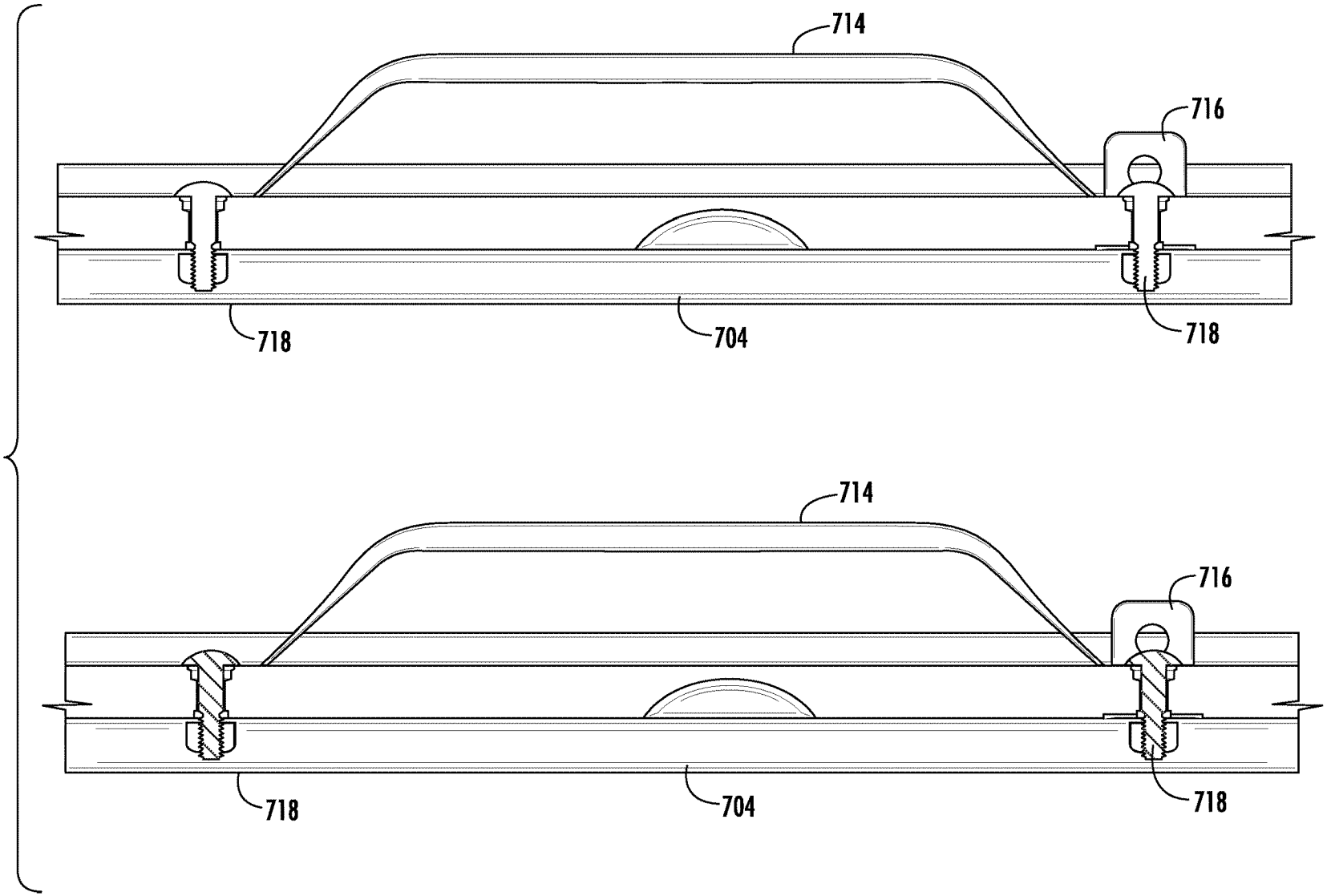
FIG. 10 is two views showing the handle and lock hasp of the assembly of FIG. 7.

FIG. 7 is two perspective views showing a modular panel member (door) having a reinforcing member. FIG. 8 is two magnified views of one end of the reinforcing member, channel and bores of the panel of FIG. 7. FIG. 9 is two views showing the handle and lock hasp of the assembly of FIG. 7. FIG. 10 is two views showing the handle and lock hasp of the assembly of FIG. 7.

As shown in FIGS. 7-10, a modular assembly 700 includes a first molded panel 702 having an elongated channel 710 formed on a first surface thereof and having two molded blind bores 708 at opposite ends thereof, the blind bores 708 extending in substantially the same direction as the elongated channel 710, an elongated reinforcing member 704 positioned in the channel 710 and including pins 706 extending from opposite ends thereof, the pins 706 being sized and shaped to be retained within the blind bores 708, and at least one fastener 718 configured to retain the elongated reinforcing member 704 within the channel 710, wherein the elongated reinforcing member 704 provides structural reinforcement to the first molded panel 702. It should be understood that the features described above with reference to FIGS. 1-6 likewise may be utilized in the design of FIGS. 7-10, which illustrates a molded panel 702 that is a panel for a modular storage enclosure, namely a shed. In particular, molded panel 702 is a door for a shed.

As shown in FIGS. 9-10, in such embodiments, the at least one fastener 718 may be further configured to secure the door handle 714 and/or lock hasp 716 to the first molded panel 702, in addition to securing the reinforcing member 704 thereto. That is, the orientation of components may be made such that fastening elements are able to capture multiple parts being attached to the plastic parts. Thus, the components may be fit to a plastic part in an orientation that layers and aligns each to allow one fastening method to secure all components (e.g., handle, hasp).

Thus, these assemblies provide a metal reinforcement to support the handle-edge of the blow molded shed doors, the reinforcement having pins affixed or coupled at each end, the pins engaging into the enclosed areas of the blow molded article to secure the top and bottom of the door thus providing resistance to deflection due to heat histories (e.g., warp induced by heating/cooling cycles from sunlight). Further securing of the reinforcement component to the blow molded door panel may be provided by the exterior door handle (a separate component) attachment/fixed to/through the door reinforcement component.

Methods of constructing the modular assemblies described with reference to FIGS. 1-10 are also provided herein. In certain embodiments, these methods include positioning the elongated reinforcing member in the channel, such that a first of the pins enters a first of the blind bores, sliding the elongated reinforcing member in the channel, such that a second of the pins enters a second of the blind bores, centering the elongated reinforcing member in the channel, and fastening the elongated reinforcing member to the first molded panel via at least one fastener. As discussed above, the fastening step may be a single step, such as one utilizing only one fastener, which represents a significant improvement over prior methods requiring multiple fastening steps.

Modular Enclosures with a Dormer

Also provided herein are modular enclosures having a dormer. As used herein, the term "dormer" is used to refer to a roofed structure that projects vertically, relative the ground, beyond the plane of the roof or other surface plane from which it extends.

In certain embodiments, a modular enclosure includes a plurality of enclosure panels defining an enclosed storage volume, wherein at least one of the plurality of enclosure panels is a first roof panel having a dormer opening, a plurality of dormer wall panels extending from the first roof panel about the dormer opening, and at least one dormer roof panel transverse to the plurality of dormer wall panels, the plurality of dormer wall panels and the dormer roof panel collectively defining a dormer. In certain embodiments, the dormer contains at least one window configured to allow light external to the modular enclosure to enter the storage volume. For example, as shown in FIGS. 19-22, the modular enclosure may be a storage enclosure, such as a shed, like a utility or tool shed, or another type of modular enclosure.

Figure 19:
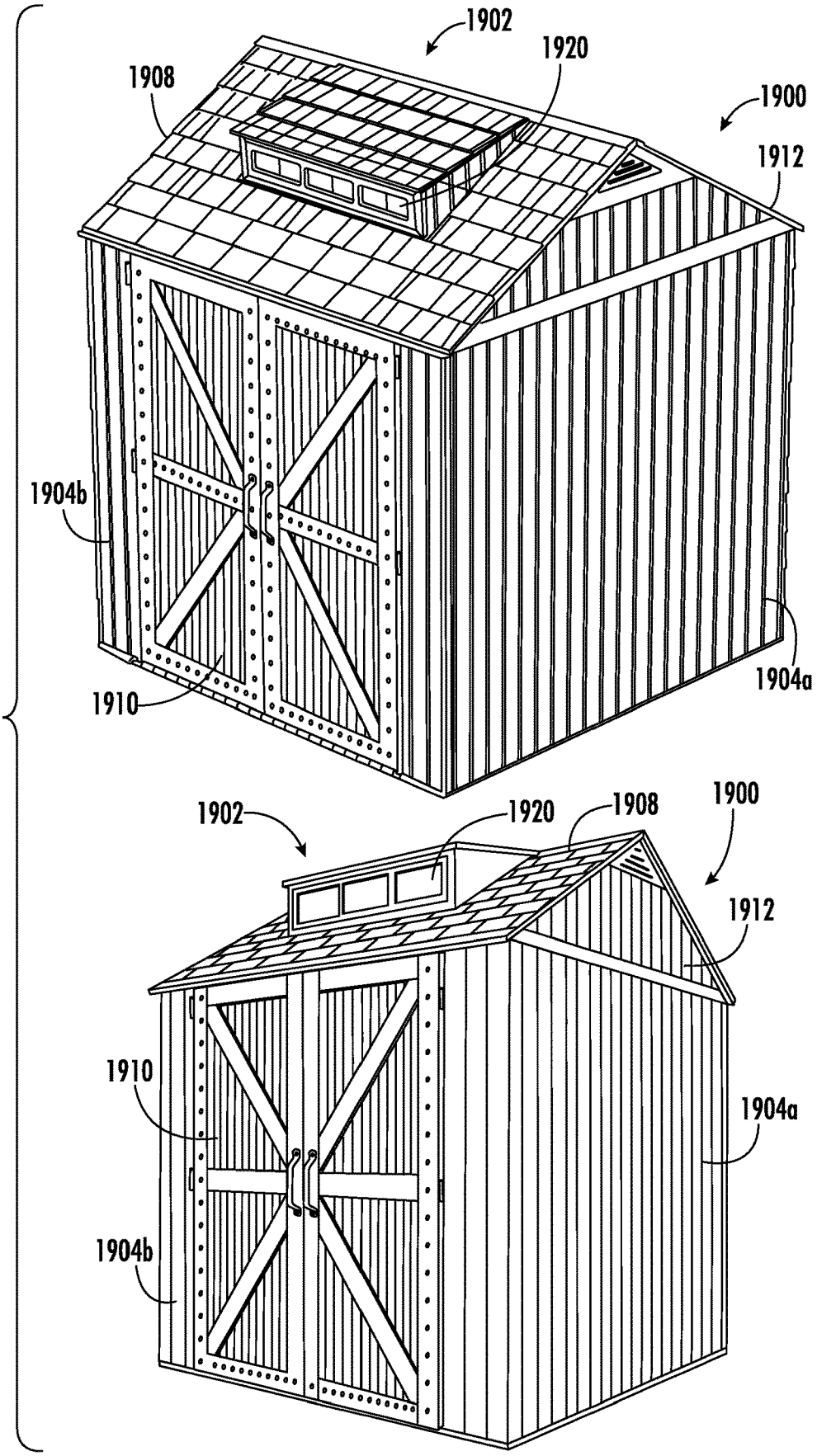
FIG. 19 is an upper and a lower perspective view of a modular storage enclosure having a roof dormer, in accordance with the present disclosure.
Figure 20:
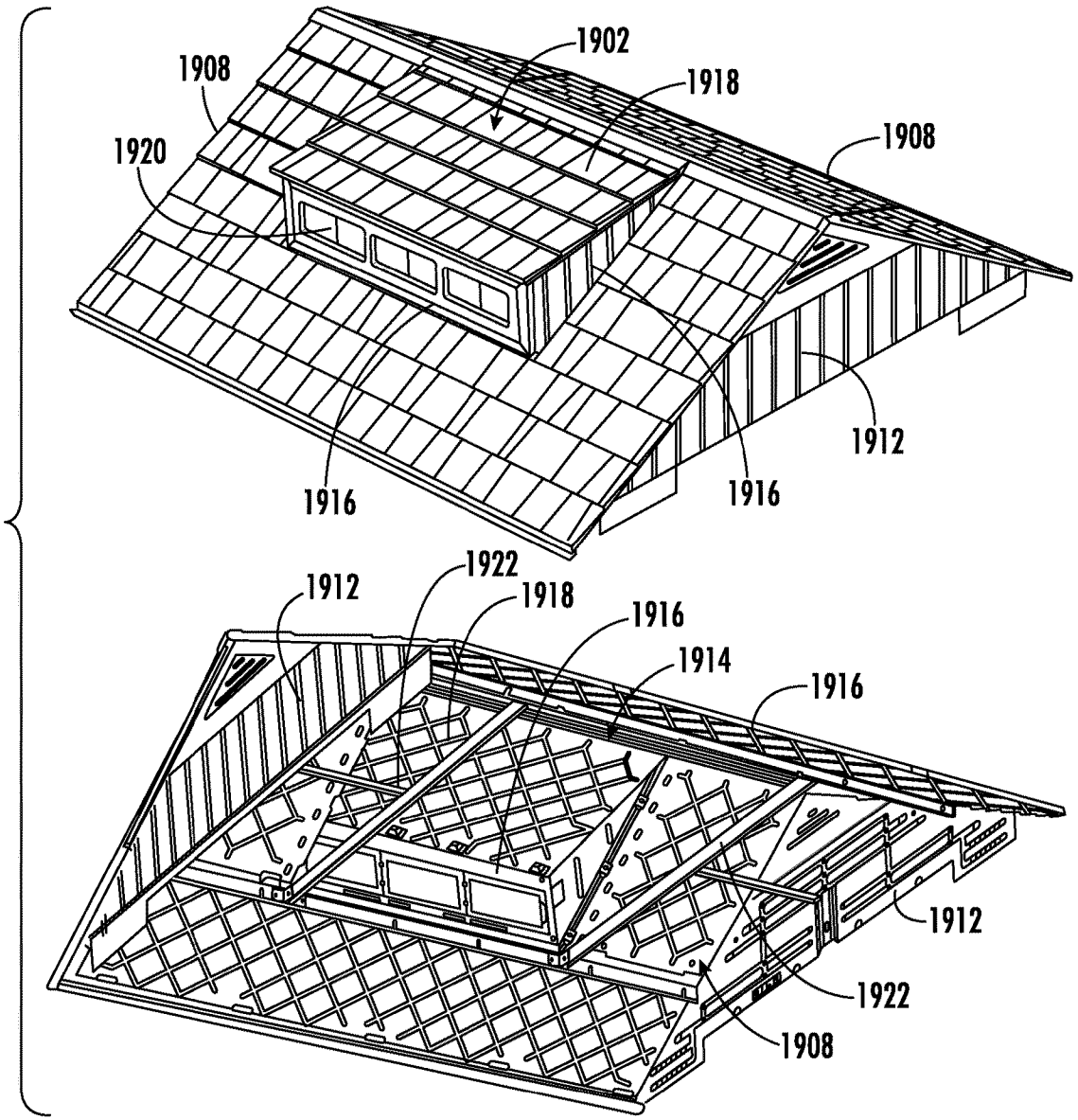
FIG. 20 is an upper and a lower perspective view of the roof and dormer of FIG. 19.
Figure 21:
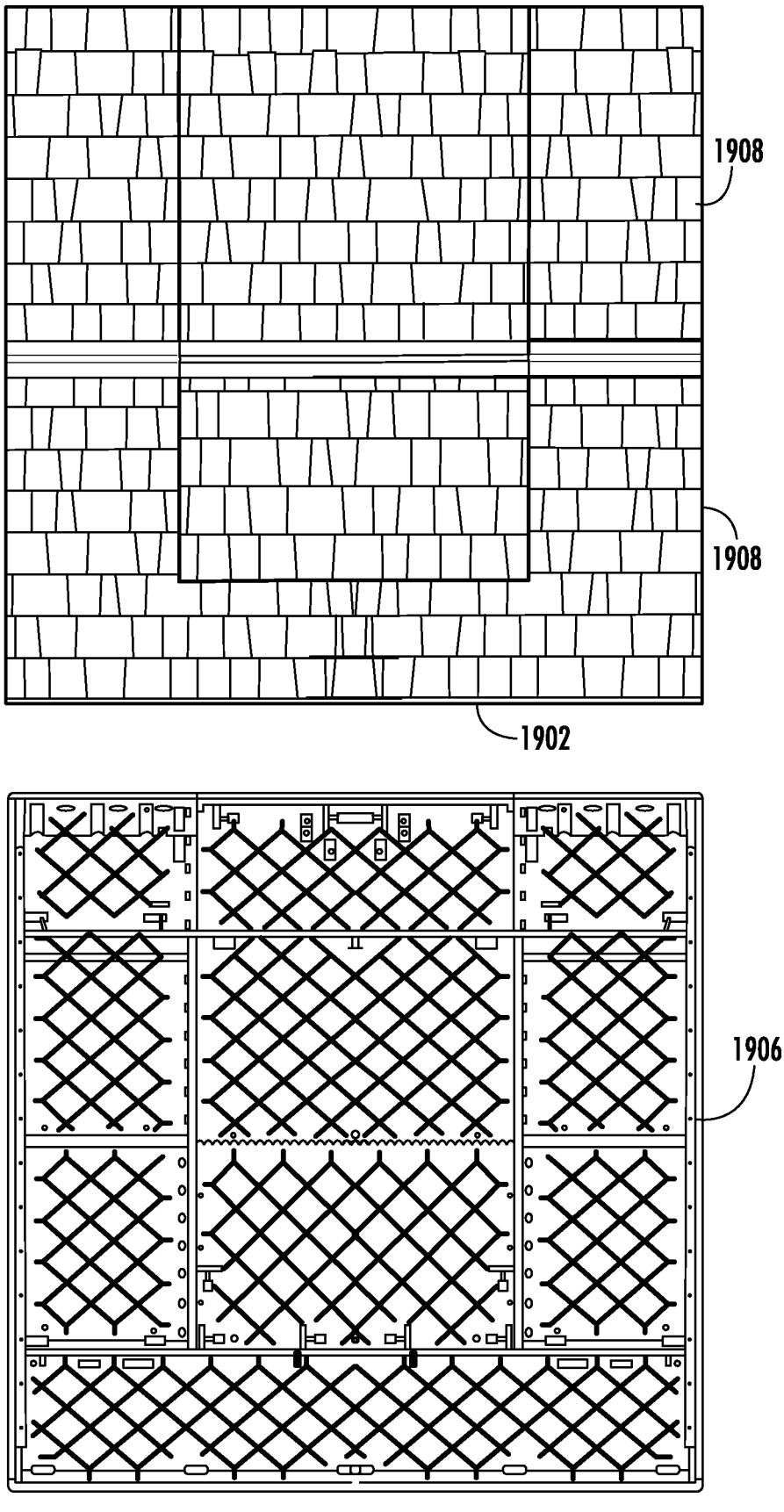
FIG. 21 is an upper and a lower plan view of the enclosure of FIG. 19.
Figure 22:
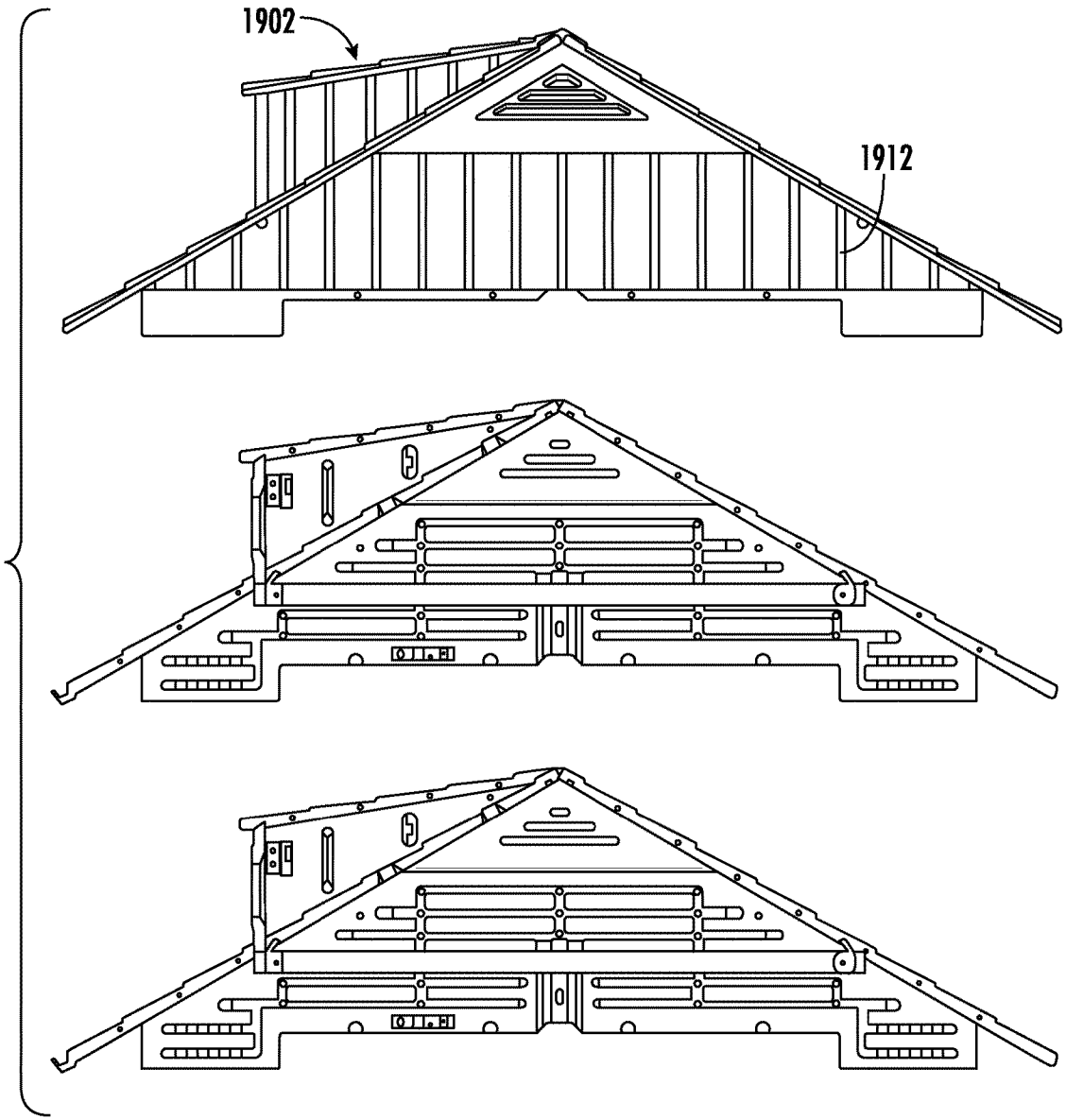
FIG. 22 is a side and a cross-sectional elevation view of the roof and dormer of FIG. 20.

FIG. 19 is an upper and a lower perspective view of a modular storage enclosure 1900 having a roof dormer 1902. FIG. 20 is an upper and a lower perspective view of the roof and dormer of FIG. 19. FIG. 21 is an upper and a lower plan view of the enclosure of FIG. 19. FIG. 22 is a side and a cross-sectional elevation view of the roof and dormer of FIG. 20. The modular storage enclosure 1900 is a utility shed having a plurality of enclosure panels 1904*a-d*, an optional base enclosure panel 1906 that defines a floor of the modular storage enclosure 1900, and at least one roof panel 1908 having a dormer opening therein. Collectively, the enclosure panels 1904*a-d*, base panels 1906, and roof panels 1908 define the enclosed storage volume. Any suitable number and configuration of panels may be used to form the enclosed storage volume. In certain embodiments, the plurality of enclosure panels includes a base panel, at least four side wall panels, and a plurality of roof panels. In certain embodiments, suitable vents, windows, or other fixtures or features are provided on the panels. In one embodiment, at least one of the at least four side wall panels 1904*b* includes a door 1910 configured to provide selective access to the storage volume.

In certain embodiments, the panels of the modular enclosure are configured to provide resistance to water intrusion into the enclosed storage volume. That is, the panel orientation, installation, and assembly may be configured in a manner that provides water intrusion management.

In certain embodiments, at least one of the roof panels 1908 is slanted, pitched, or otherwise angled with respect to the base panel 1906. In other embodiments, one or more of the roof panels 1908 are substantially flat or parallel to the base panel 1906. In embodiments having at least one slanted roof panel 1908, the modular enclosure may further include gable panels 1912 positioned between the side wall panels and the slanted roof panels.

As seen in FIG. 20, in certain embodiments, at least one of the roof panels 1908 defines a dormer opening 1914 therein. A plurality of dormer wall panels 1916 extend from the roof panel 1908 about the dormer opening and at least one dormer roof panel 1918 is positioned transverse to the plurality of dormer wall panels 1916, the plurality of dormer wall panels 1916 and the dormer roof panel 1918 collectively defining the dormer 1902. In certain embodiments, the plurality of dormer wall panels 1916 includes three panels extending vertically between the first roof panel 1908 and the at least one dormer roof panel 1918.

As shown in FIG. 20, in certain embodiments, the dormer 1902 defines a dormer storage volume in communication with the enclosed storage volume. For example, the dormer storage volume may provide additional useful storage volume for the storage of articles and/or may provide additional useful volume for movement within the enclosure.

In certain embodiments, the dormer 1902 contains at least one window 1920 configured to allow light external to the modular enclosure 1900 to enter the storage volume. For example, the window(s) 1920 may be disposed in any of the panels forming the dormer 1902, to provide the desired amount of light exposure to the enclosed storage volume.

In certain embodiments, as shown in FIG. 20, the enclosure 1900 includes at least one support beam 1922 that extends adjacent the dormer opening 1914 and provides reinforcement thereto.

As described herein, the various enclosure panels (e.g., side wall, base, and roof panels), the dormer wall panels, and dormer roof panels may all be formed of a plastic material. Suitable connection means, such as those described herein, may be used to connect and configured the panels to form the enclosure assembly. Suitable fixtures (e.g., handles) and other features may be provided.

Thus, various modular enclosures, assemblies, and structures have been provided having improved structural and other properties.

While the disclosure has been described with reference to a number of embodiments, it will be understood by those skilled in the art that the disclosure is not limited to such disclosed embodiments. Rather, the disclosure can be modified to incorporate any number of variations, alterations, substitutions, or equivalent arrangements not described herein, but which are commensurate with the spirit and scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements or functional capabilities. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A modular assembly, comprising:

a first panel having a first edge, the first edge comprising at least one bore;

a second panel having a second edge, the second edge comprising at least one bore, wherein the first and second panels are substantially planar;

an elongated structural reinforcing member sized and shaped for positioning between the first and second edges; and at least one connector pin having two prongs, wherein the connector pin is sized and shaped such that a first prong of a connector pin is positionable within the bore of the first edge and a second prong of the connector pin is positionable within the corresponding bore of the second edge, such that the connector pin connects the first and second panels.

2. The modular assembly of claim 1, wherein at least one of the first and second panels comprises an overhang extending past the respective panel edge, such that the overhang in combination with the at least one connector pin laterally restrains at least a portion of the elongated structural reinforcing member.

3. The modular assembly of claim 2, wherein both the first and second panels comprise an overhang extending past the respective panel edges, such that the overhangs in combination with the at least one connector pin laterally restrain the elongated structural reinforcing member.

4. The modular assembly of claim 1, wherein:

the first and second edges each comprises a series of bores, and the at least one connector pin comprises a corresponding number of connector pins positionable within the series of bores, to connect the first and second panels along a length of the first and second edges.

5. The modular assembly of claim 1, wherein the structural reinforcing member comprises a metal tube.

6. The modular assembly of claim 1, wherein the at least one connector pin has a u-shape.

7. The modular assembly of claim 1, wherein the at least one connector pin is formed of metal.

8. The modular assembly of claim 1, wherein the bores are blind bores.

9. The modular assembly of claim 1, wherein the bores are through-holes.

10. The modular assembly of claim 1, wherein the bores extend in a direction substantially parallel to a direction in which the elongated structural reinforcing member extends.

11. The modular assembly of claim 1, wherein the first and second edges each further comprise a groove or pair of grooves adjacent the bore, to provide access to the bores.

12. The modular assembly of claim 1, wherein the bores and the connector pin are sized and shaped to provide secure attachment of the first and second panels in directions parallel to and perpendicular with the first and second panels.

13. The modular assembly of claim 1, wherein the bores comprise an interference feature to prevent movement of a connector pin positioned therein.

14. A modular assembly, comprising:

a first molded panel comprising an elongated channel formed on a first surface thereof, the elongated channel comprising two molded blind bores at opposite ends thereof, the blind bores extending in substantially the same direction as the elongated channel;

an elongated reinforcing member positioned in the channel, the elongated reinforcing member comprising pins extending from opposite ends thereof, the pins being sized and shaped to be retained within the blind bores; and at least one fastener configured to retain the elongated reinforcing member within the channel, wherein the elongated reinforcing member provides structural reinforcement to the first molded panel.

15. The modular assembly of claim 14, wherein the first molded panel, the elongated channel, and the blind bores are blow molded.

16. The modular assembly of claim 14, wherein the elongated channel is at or adjacent an edge of the first molded panel, the elongated channel extending substantially parallel to the edge.

17. The modular assembly of claim 14, wherein the first molded panel is formed of a plastic material.

18. The modular assembly of claim 14, wherein the elongated reinforcing member is formed of metal.

19. The modular assembly of claim 14, wherein the elongated reinforcing member comprises a cross-sectional shape that is curved, S-shaped, or otherwise fit to the corresponding surface of the elongated channel.

20. The modular assembly of claim 14, wherein the elongated channel and the elongated reinforcing member are sized and shaped, such that the channel accommodates installation of a first of the pins into a first of the blind bores, with clearance in the channel to then install a second of the pins into a second of the blind bores.

21. The modular assembly of claim 14, wherein the first molded panel comprises a door for a modular storage enclosure.

22. The modular assembly of claim 21, wherein the modular storage enclosure is a shed.

23. The modular assembly of claim 21, wherein the at least one fastener is further configured to secure the door handle and/or lock hasp to the first molded panel.

24. The modular assembly of claim 14, wherein the first molded panel comprises a lid for a storage container.

25. The modular assembly of claim 14, wherein the at least one fastener is a threaded fastener.

26. The modular assembly of claim 25, wherein the threaded fastener is a screw.

27. A modular assembly, comprising:

a first panel having a first edge, the first edge comprising at least one bore;

a second panel having a second edge, the second edge comprising at least one bore;

an elongated structural reinforcing member sized and shaped for positioning between the first and second edges; and at least one connector pin having two prongs, wherein the connector pin is sized and shaped such that a first prong of a connector pin is positionable within the bore of the first edge and a second prong of the connector pin is positionable within the corresponding bore of the second edge, such that the connector pin connects the first and second panels;

wherein at least one of the first and second panels comprises an overhang extending past the respective panel edge, such that the overhang in combination with the at least one connector pin laterally restrains at least a portion of the elongated structural reinforcing member.

28. The modular assembly of claim 27, wherein both the first and second panels comprise an overhang extending past the respective panel edges, such that the overhangs in combination with the at least one connector pin laterally restrain the elongated structural reinforcing member.

29. The modular assembly of claim 27, wherein:

the first and second edges each comprises a series of bores, and the at least one connector pin comprises a corresponding number of connector pins positionable within the series of bores, to connect the first and second panels along a length of the first and second edges.

30. The modular assembly of claim 27, wherein the structural reinforcing member comprises a metal tube.

31. The modular assembly of claim 27, wherein the at least one connector pin has a u-shape.

32. The modular assembly of claim 27, wherein the at least one connector pin is formed of metal.

33. The modular assembly of claim 27, wherein the bores are blind bores.

34. The modular assembly of claim 27, wherein the bores are through-holes.

35. The modular assembly of claim 27, wherein the bores extend in a direction substantially parallel to a direction in which the elongated structural reinforcing member extends.

36. The modular assembly of claim 27, wherein the first and second edges each further comprise a groove or pair of grooves adjacent the bore, to provide access to the bores.

37. The modular assembly of claim 27, wherein the first and second panels are substantially planar.

* * * * *